US008597728B2

(12) United States Patent
Nitta et al.

(10) Patent No.: US 8,597,728 B2
(45) Date of Patent: Dec. 3, 2013

(54) FILM FORMING METHOD

(75) Inventors: Yasutaka Nitta, Kitakyushu (JP); Tomokazu Ito, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 112 days.

(21) Appl. No.: 13/230,975

(22) Filed: Sep. 13, 2011

(65) Prior Publication Data

US 2012/0064237 A1 Mar. 15, 2012

(30) Foreign Application Priority Data

Sep. 15, 2010 (JP) ..... 2010-206517
Jul. 26, 2011 (JP) ..... 2011-163158

(51) Int. Cl.
*B05D 1/12* (2006.01)
*B05D 1/40* (2006.01)
*B05D 1/02* (2006.01)

(52) U.S. Cl.
USPC ..... 427/180; 427/480; 427/421.1; 427/427.3

(58) Field of Classification Search
USPC ..... 427/189, 427, 427.1–427.3, 425, 98, 427/555, 552, 284, 180, 480, 421.1
See application file for complete search history.

(56) References Cited

U.S. PATENT DOCUMENTS 6,165,562 A * 12/2000 Mizuno ..... 427/8

FOREIGN PATENT DOCUMENTS

| | | | |
|---|---|---|---|
| JP | 2002-020878 A | | 1/2002 |
| JP | 2008-007804 A | | 1/2008 |
| JP | 2008069399 A | * | 3/2008 |
| JP | 2008-240068 A | | 10/2008 |

* cited by examiner

*Primary Examiner* — Timothy Meeks
*Assistant Examiner* — Ann Disarro
(74) *Attorney, Agent, or Firm* — Studebaker & Brackett PC

(57) ABSTRACT

There is disclosed a film forming method of spraying an aerosol jetted from a nozzle on a film formation object, while continuously changing a spraying position of the aerosol, to form a film which continuously covers an upper surface, an outer surface and a curved surface, which enables continuous formation of a high-quality film by a simple process. This film forming method includes a first film forming step of continuously spraying the aerosol on an upper surface W01 and a curved surface W03 connected to the upper surface W01, to continuously form a film which covers the upper surface W01 and a film which covers at least part of the curved surface W03; and a second film forming step of continuously forming a film which covers an outer surface W02 and a film which further covers the film formed on the curved surface W03 in the first film forming step.

6 Claims, 13 Drawing Sheets

FILM FORMING METHOD

BACKGROUND OF THE INVENTION

1. Field of the Invention

The present invention relates to a film forming method of spraying an ultrafine particle material jetted from a nozzle onto an object to form a film on the object.

2. Description of the Related Art

Such a film forming technology includes the steps of aerosolizing, with an inactive gas or the like, ultrafine particles made of a ceramic material or a metal material and having particle diameters of 100 μm or smaller to form an ultrafine particle material, and spraying this ultrafine particle material onto an object to deposit a film on the object, and this film formation technology is broadly known as an aerosol deposition method (see e.g. Patent Document 1 described below). In the film forming method disclosed in Patent Document 1, there has been suggested a film forming method which can form a film including sufficiently joined ultrafine particles therein, and having a dense structure, a smooth surface and a uniform density. Specifically, the ultrafine particle material is obliquely sprayed onto a flat surface constituting the object. When the ultrafine particle material is obliquely sprayed in this manner, a high-quality film can be formed.

The film forming method disclosed in Patent Document 1 is a remarkably effective technology in a case where surfaces constituting the object are only flat surfaces, but the technology needs to be further contrived in a case where the surfaces constituting the object include curved surfaces. Specifically, the method is contrived so that a jet angle of the ultrafine particle material keeps to be constant even on the curved surfaces. For example, a technology disclosed in Patent Document 2 described below has been suggested.

In a film forming method disclosed in Patent Document 2, a film is formed on a curved surface constituting an object having a cylindrical shape. An ultrafine particle material is sprayed on the curved surface which is an outer periphery of the cylindrical object, while rotating the cylindrical object around a central axis of the cylindrical object. More specifically, the ultrafine particle material is sprayed on the cylindrical object while rotating the object, and ultrafine particles in the ultrafine particle material reflected by the curved outer peripheral surface of the cylindrical object are allowed to secondarily collide with the surface, to form a uniform film.

Moreover, a film forming method disclosed in Patent Document 3 described below has been suggested as one of film forming methods in a case where the curved surface is formed in part of the outer periphery of the object. In the film forming method disclosed in Patent Document 3, a nozzle for exclusive use having an opening with a width substantially equal to that of the curved surface formed in part of the outer periphery of the object is used, to form a highly dense film on the curved surface.

PRIOR ART DOCUMENTS

Patent Documents

[Patent Document 1] JP-A-2002-20878
[Patent Document 2] JP-A-2008-7804
[Patent Document 3] JP-A-2008-240068

SUMMARY OF THE INVENTION

Problem to be Solved by the Invention

In film formation by an aerosol deposition method, an ultrafine particle material is obliquely sprayed onto the surface of a film formation object while keeping a constant angle as disclosed in Patent Document 1 described above, which is a requirement for forming a film having a high density and a high quality. A film forming method disclosed in Patent Document 2 described above is developed on the assumption that an object has a cylindrical shape. A position of a nozzle for jetting an ultrafine particle material is fixed, and the ultrafine particle material is sprayed on an object while rotating the object. It is true that this film forming method can comparatively easily be realized, when the object has the cylindrical shape. However, for example, when part of the object is formed by a curved surface and a remaining part thereof is formed by a flat surface as in a case where a rectangular parallelepiped object is chamfered along ridge lines thereof, it is remarkably difficult to form a dense film having a high quality.

When the film forming method disclosed in Patent Document 2 is applied to the case where part of the object is formed by the curved surface and the remaining part thereof is formed by the flat surface, it is necessary to rotate the object or the nozzle so that the only curved surface of the object directly faces the nozzle, to spray the ultrafine particle material only on the curved surface. In this case, it is necessary to realize a rotating operation in a remarkably small region, and it becomes remarkably difficult to realize the operation. Furthermore, when a curvature radius of the curved surface is small, a necessity of remarkably increasing a speed of the rotating operation also arises, and hence it becomes more difficult to realize the operation.

On the other hand, when a film forming method disclosed in Patent Document 3 described above is applied, the above-mentioned theme of the rotating operation does not arise, but it is necessary to use a nozzle for exclusive use in forming a film on a curved surface. In consequence, there arises a necessity of replacing a nozzle for forming the film on a flat surface with the nozzle for forming the film on the curved surface, or a necessity of constructing a special mechanism for using both the nozzles together. Therefore, it becomes difficult to realize the method, from the viewpoints of intricacy of an operation or complication of the mechanism. Furthermore, when the film forming method disclosed in Patent Document 3 is applied, the film is not continuously formed on the flat surface and the curved surface. Therefore, a joined portion between the film formed on the flat surface and the film formed on the curved surface does not become an integral portion, and in the joined portion, a film quality might deteriorate.

The present invention has been developed in view of such a problem, and an object thereof is to provide a film forming method which sprays an ultrafine particle material jetted from a nozzle on an object including a first flat surface, a second flat surface having an angle of 90 degrees or larger and smaller than 180 degrees between the first flat surface and the second flat surface and a curved surface connecting the first flat surface to the second flat surface, while continuously changing a spraying position of the ultrafine particle material, to form a film which continuously covers the first flat surface, the second flat surface and the curved surface. The film forming method enables the continuous formation of a film having a high quality by a simple process.

Means for Solving the Problem

A film forming method for solving the above problems according to the present invention is a film forming method which sprays an ultrafine particle material jetted from a nozzle on an object including a first flat surface, a second flat surface having an angle of 90 degrees or larger and smaller than 180 degrees between the first flat surface and the second flat surface and a curved surface connecting the first flat surface to the second flat surface, while continuously changing a spraying position of the ultrafine particle material, to form a film which continuously covers the first flat surface, the second flat surface and the curved surface, the film forming method comprising: a first arranging step; a first film forming step; a second arranging step; and a second film forming step.

In the first arranging step, the nozzle is arranged to face the first flat surface so that an angle formed between a jet line along a jet direction of the ultrafine particle material and the first flat surface is in a range of 30 degrees to 60 degrees and so that an angle formed between a first virtual line obtained by projecting the jet line on the first flat surface and a first boundary line is in a range of 0 degree to 60 degrees in a case where the nozzle is positioned so that the jet line hits the first boundary line which is a boundary between the first flat surface and the curved surface.

The first film forming step continued from the first arranging step or executed in parallel with the first arranging step jets the ultrafine particle material from the nozzle, while keeping a distance and an angle between the nozzle and the first flat surface, and continuously sprays the ultrafine particle material on the first flat surface and the curved surface connected to the first flat surface, to continuously form a film which covers the first flat surface and a film which covers at least part of the curved surface.

In the second arranging step, the nozzle is arranged to face the second flat surface so that an angle formed between the jet line along the jet direction of the ultrafine particle material and the second flat surface is in a range of 30 degrees to 60 degrees and so that an angle formed between a second virtual line obtained by projecting the jet line on the second flat surface and a second boundary line is in a range of 0 degree to 60 degrees in a case where the nozzle is positioned so that the jet line hits the second boundary line which is a boundary between the second flat surface and the curved surface.

The second film forming step continued from the second arranging step or executed in parallel with the second arranging step jets the ultrafine particle material from the nozzle, while keeping a distance and an angle between the nozzle and the second flat surface, and continuously sprays the ultrafine particle material on the second flat surface and the curved surface connected to the second flat surface, to continuously form a film which covers the second flat surface and a film which further covers the film formed on the curved surface in the first film forming step.

In the film forming method according to the present invention described above, the first film forming step jets the ultrafine particle material from the nozzle, while keeping the distance and the angle between the nozzle and the first flat surface, and continuously changes a spraying position of the ultrafine particle material, to continuously form the film which covers the first flat surface and the film which covers at least part of the curved surface. Therefore, the film which covers the first flat surface can be formed integrally with the film which covers the curved surface, to enable the film formation which does not generate any gap in a joined portion. Furthermore, the second film forming step executed after the first film forming step jets the ultrafine particle material from the nozzle, while keeping the distance and the angle between the nozzle and the second flat surface, and continuously changes the spraying position of the ultrafine particle material, to continuously form the film which covers the second flat surface and the film which further covers the film formed on the curved surface in the first film forming step. Therefore, the film which covers the second flat surface can be formed integrally with the film which further covers the film formed on the curved surface, which enables the film formation which does not generate any gap in the joined portion. When the curved surface is noted, the film formed in the second film forming step is superimposed on the film formed in the first film forming step, and hence high adhesion of the film formed in the first film forming step to the object are taken into consideration. On the other hand, high adhesion of the film formed in the second film forming step to a film in a lower layer and an appearance thereof can be taken into consideration. This enables optimized film formations for the respective steps.

Further in the present invention, the arrangement of the nozzle with respect to the object is contrived in the first arranging step, to further secure the film formation on the first flat surface and the curved surface in the first film forming step. Specifically, the nozzle is arranged so that the angle formed between the jet line and the first flat surface is in a range of 30 degrees to 60 degrees. When the nozzle is arranged in this manner, the nozzle can be arranged to obtain an incident angle which is appropriate for the film formation on the first flat surface. When the film formation only on the first flat surface is considered, the angle formed between the first flat surface and the jet line may appropriately be set, whereby an incident direction of the jet line on the first flat surface can be varied as long as the formed angle is held.

The present inventors have noted this respect, and arranges the nozzle so as to satisfy additional conditions while maintaining the above conditions of the angle formed between the jet line and the first flat surface. That is, when the nozzle is positioned so that the jet line hits the first boundary line which is the boundary between the first flat surface and the curved surface, the nozzle is arranged so that the angle formed between the first virtual line obtained by projecting the jet line on the first flat surface and the first boundary line is in a range of 0 degree to 60 degrees.

In particular, when the first flat surface is substantially orthogonal to the second flat surface, the nozzle may be arranged so that a first side angle seen through a side directly facing the second flat surface (a direction directly facing the second flat surface at a position where the jet line crosses the first flat surface) is in a range of 30 degrees to 60 degrees in a case where the nozzle is positioned so that the jet line hits the first boundary line which is the boundary between the first flat surface and the curved surface. Also in this case, the arrangement of the nozzle satisfies the above conditions.

When the step is contrived to set the angle between the object and the nozzle in this manner, the first film forming step can securely form the high-quality film even on an object having a curved surface with a remarkably small curvature radius, by a simple process of moving the nozzle and the object to relatively perform a two-dimensional motion (e.g. a motion to rotate the object or move the nozzle in parallel with the object).

Further in the present invention, the arrangement of the nozzle with respect to the object is contrived in the second arranging step, to further secure the film formation on the second flat surface and the curved surface in the second film forming step. In this case, the nozzle is arranged with respect to the object in the same manner as in the first arranging step, in which the first flat surface is read as the second flat surface. When such a contrivance is made, the second film forming step can securely form a high-quality film even on the object having the curved surface with the remarkably small curvature radius, by the simple process of moving the nozzle and the object to perform the relative two-dimensional motion (e.g. the motion to rotate the object or move the nozzle in parallel with the object).

Moreover, in the film forming method according to the present invention, the first arranging step preferably arranges the nozzle and the object so that the angle formed between the jet line and the first flat surface is larger than the angle between the first virtual line and the first boundary line.

In this preferable configuration, the first arranging step arranges the nozzle and the object so that the angle formed between the jet line and the first flat surface becomes larger than the angle between the first virtual line and the first boundary line. Therefore, the angle formed between the jet line and the first flat surface is set to be remarkably large, whereas the angle between the first virtual line and the first boundary line can be set to be relatively small. Therefore, when the first film forming step sprays the ultrafine particle material on the first flat surface, efficient film formation is enabled, and a high film forming speed can be kept. Since the second film forming step also forms the film on the curved surface, it is preferably considered that the high adhesion to the object are important in the film formation of the first film forming step, which does not generate a defect such as peeling. Therefore, the first arranging step sets the angle formed between the first virtual line and the first boundary line to be relatively small, and sets a jet angle of the ultrafine particle material on the curved surface to be small, whereby the high-quality film having satisfactory high adhesion to the object can be formed.

Moreover, in the film forming method according to the present invention, the second arranging step preferably arranges the nozzle and the object so that the angle formed between the jet line and the second flat surface is larger than the angle formed between the second virtual line and the second boundary line and so that the angle between the second virtual line and the second boundary line is larger than the angle formed between the first virtual line and the first boundary line in the first arranging step.

In particular, when the first flat surface is substantially orthogonal to the second flat surface, the nozzle and the object may be arranged so that the angle formed between the jet line and the second flat surface is larger than the angle formed between the second virtual line and the second boundary line and so that a second side angle in the second arranging step is larger than a first side angle in the first arranging step. Here, the second side angle is an angle formed between the jet line and the second flat surface, when seen through a side directly facing the first flat surface (a direction directly facing the first flat surface at a position where the jet line crosses the second flat surface). Also in this case, the arrangement of the nozzle satisfies the above conditions.

In this preferable configuration, the second arranging step arranges the nozzle and the object so that the angle formed between the jet line and the second flat surface becomes larger than the angle formed between the second virtual line and the second boundary line. Therefore, the angle formed between the jet line and the second flat surface is set to be relatively large, whereas the angle formed between the second virtual line and the second boundary line can be set to be relatively small. Therefore, when the second film forming step sprays the ultrafine particle material on the second flat surface, the efficient film formation is enabled, and the high film forming speed can be kept. Since the first film forming step already forms the film on the curved surface, the angle formed between the second virtual line and the second boundary line is set to be relatively small, thereby lowering the film forming speed. It is eventually possible to prevent the film formed on the curved surface from being excessively thick.

Furthermore, in this preferable configuration, the nozzle and the object are arranged so that the angle formed between the second virtual line and the second boundary line becomes larger than the angle formed between the first virtual line and the first boundary line in the first arranging step. Therefore, the angle formed between the second virtual line and the second boundary line in the second arranging step can be set to be relatively large as compared with the angle formed between the first virtual line and the first boundary line in the first arranging step. When the angle formed between the second virtual line and the second boundary line is set to be large, the film forming speed on the curved surface in the second film forming step can further be raised. As described above, the film is already formed on the curved surface in the first film forming step. Therefore, even if a forming speed of a film to be superimposed on the above film is raised, a defect such as the peeling does not easily occur. In consequence, when the angle formed between the second virtual line and the second boundary line is set as in this preferable configuration, it is possible to acquire the high adhesion of the film formed on the curved surface to the object and a productivity thereof.

Moreover, in the film forming method according to the present invention, the first arranging step preferably arranges the nozzle and the object so that the angle formed between the jet line and the second flat surface is 60 degrees or smaller.

In particular, when the first flat surface is substantially orthogonal to the second flat surface, the first arranging step may arrange the nozzle and the object so that as the angle formed between the jet line and the second flat surface, the second side angle is 60 degrees or smaller. Also in this case, the arrangement of the nozzle satisfies the above conditions.

In this preferable configuration, the first arranging step sets the angle formed between the jet line and the second flat surface to be 60 degrees or smaller. Therefore, even when the ultrafine particle material jetted from the nozzle reaches the second flat surface in the first film forming step, the incident angle on the second flat surface does not exceed 60 degrees. In consequence, it is possible to prevent a low-quality film having low adhesion properties from being formed on the second flat surface on which any film is not formed yet.

It is to be noted that when the first flat surface is substantially orthogonal to the second flat surface, the nozzle and the object are preferably arranged so that as the angle formed between the jet line and the second flat surface, the second side angle is 30 degrees or smaller in the first arranging step and so that as the angle formed between the jet line and the first flat surface, the first side angle is 30 degrees or smaller in the second arranging step. When the first flat surface is substantially orthogonal to the second flat surface, the nozzle is arranged in this manner. In this case, even when the ultrafine particle material jetted from the nozzle reaches the second flat surface in the first film forming step, the incident angle on the second flat surface is small, whereby the angle can be set so that the material does not contribute to the film formation. Therefore, the first film forming step can prevent the film from being formed on the second flat surface, whereby it is possible to prevent unnecessary film formation on the second flat surface which is not assumed as a film forming surface in the first film forming step.

Similarly, as the angle formed between the jet line and the first flat surface, the first side angle is set to be 30 degrees or smaller in the second arranging step. Therefore, even when the ultrafine particle material jetted from the nozzle reaches the first flat surface in the second film forming step, the incident angle on the first flat surface is small, whereby the angle can be set so that the material does not contribute to the film formation. In consequence, the first film forming step as well as the second film forming step can prevent the unnecessary film formation on the flat surface which is not assumed as the film forming surface, whereby a uniform film can be formed as a whole.

Moreover, in the film forming method according to the present invention, the first film forming step and the second film forming step preferably jet the ultrafine particle material from the nozzle so that the material is sprayed to spread more in a direction in which the spraying position of the ultrafine particle material changes toward the curved surface than in a direction in which the spraying position of the ultrafine particle material changes along the curved surface.

When the film is formed on the curved surface, repeating of a film forming operation a plurality of times while suppressing a thickness of the film formed at a time is more preferable than the forming of a thick film at a time, from the viewpoint of acquiring uniformities of the film thickness and film quality. Therefore, in this preferable configuration, the ultrafine particle material is jetted from the nozzle so that the ultrafine particle material is sprayed to spread more in the direction in which the spraying position of the material changes toward the curved surface. In consequence, even when the spraying position is changed along the curved surface, part of the film does not become thick but the film can be formed by superimposing thin films.

Moreover, in the film forming method according to the present invention, the first film forming step preferably fixes the nozzle, and moves the object along the first flat surface, to change the spraying position of the ultrafine particle material, and the second film forming step preferably fixes the nozzle, and moves the object along the second flat surface, to change the spraying position of the ultrafine particle material.

In this preferable configuration, both the first film forming step and the second film forming step fix the nozzle, and move the object along the first flat surface and the second flat surface, respectively, to change the spraying position of the ultrafine particle material. Therefore, it is possible to form the film while the nozzle is not moved. Therefore, when the nozzle is fixed, a state of the jetted ultrafine particle material can be stabilized, and the uniformities of the film thickness and film quality can be acquired.

Effect of the Invention

According to the present invention, there can be provided a film forming method which sprays an ultrafine particle material on an object including a first flat surface, a second flat surface forming an angle of 90 degrees or larger and smaller than 180 degrees between the first flat surface and the second flat surface and a curved surface connecting the first flat surface to the second flat surface, while continuously changing a spraying position of the ultrafine particle material, to form a film which continuously covers the first flat surface, the second flat surface and the curved surface, which enables continuous formation of a high-quality film by a simple process.

DESCRIPTION OF THE PREFERRED EMBODIMENTS

Figure 1:
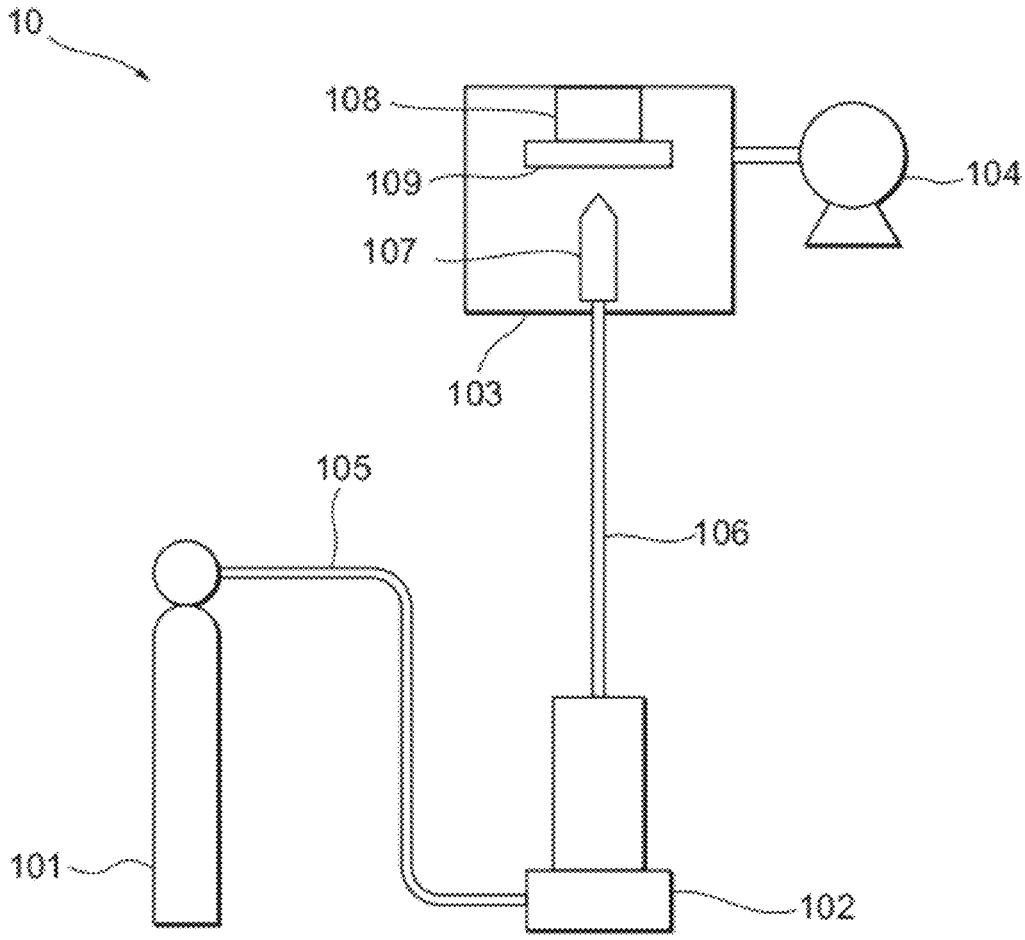
FIG. 1 is a schematic constitutional view showing a film forming device for carrying out the present invention.

Hereinafter, embodiments of the present invention will be described with reference to the accompanying drawings. To facilitate the understanding of the description, the same constitutional elements in the drawings are denoted with the same marks if possible, and redundant description is omitted.

A film forming device for use in a film forming method according to the embodiment of the present invention will be described with reference to FIG. 1. FIG. 1 is a schematic constitutional view showing a constitution of a film forming device 10. As shown in FIG. 1, the film forming device 10 includes a gas container 101, an aerosol generator 102, a film forming chamber 103, and a vacuum pump 104.

The gas container 101 is connected to the aerosol generator 102 via a carrier gas flow path 105. The aerosol generator 102 is connected to one end of an aerosol flow path 106 in addition to the carrier gas flow path 105. At the other end of the aerosol flow path 106, a nozzle 107 is provided.

The nozzle 107 is disposed in the film forming chamber 103. In the film forming chamber 103, an XYZθα stage 108 and a sample table 109 are arranged. The sample table 109 is attached to the XYZθα stage so as to enable movement along an x-axis, a y-axis and a z-axis which are orthogonal to one another, rotation in an xy-plane, and inclining for imparting tilt to the sample table 109. When the XYZθα stage 108 is regulated, a film formation object can be mounted on the sample table 109 to face the nozzle 107.

The vacuum pump 104 is also connected to the inside of the film forming chamber 103. When the vacuum pump 104 is operated, a pressure in the film forming chamber 103 can be reduced.

The aerosol generator 102 contains ceramic fine particles (ultrafine particles). In the gas container 101, a conveyance gas is placed in a sealed manner at a high pressure. Examples of the conveyance gas include inactive gases such as argon, nitrogen and helium, oxygen, dry air and a mixture gas of these gases. The conveyance gas is introduced from the gas container 101 into the aerosol generator 102 via the carrier gas flow path 105. The ceramic fine particles contained in the aerosol generator 102 and the conveyance gas conveyed from the gas container 101 into the aerosol generator 102 form an aerosol (an ultrafine particle material).

The aerosol formed in the aerosol generator 102 is supplied to the nozzle 107 via the aerosol flow path 106. The aerosol supplied to the nozzle 107 is jetted through a jet hole provided in a tip of the nozzle 107, and sprayed on an object mounted on the sample table 109 attached to the XYZθα stage 108. When the aerosol is sprayed on the object, ceramic fine particles included in the aerosol collide with the object, and a dense ceramic film is formed on the object by a mechanical impact force.

Figure 2:
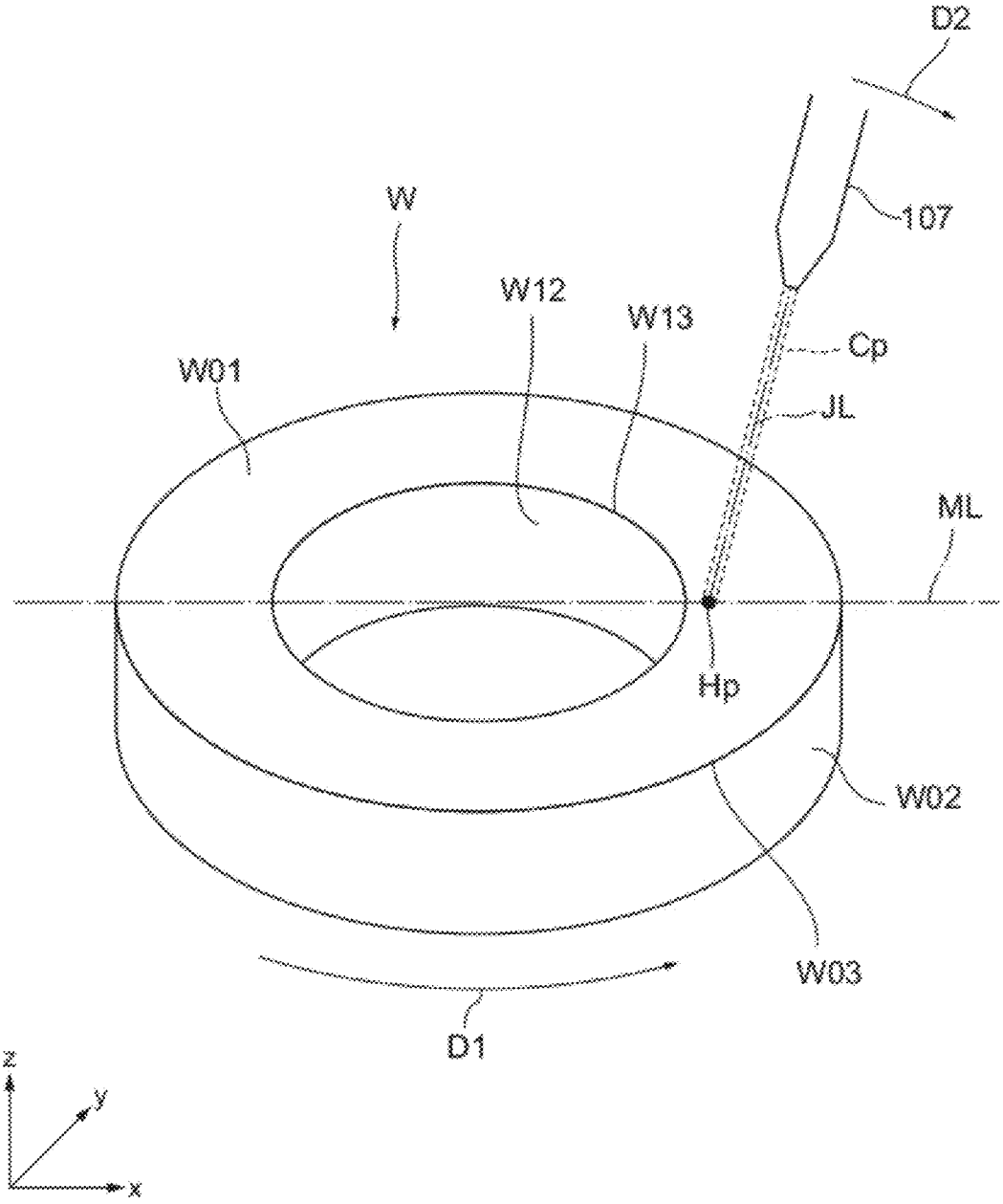
FIG. 2 is a perspective view showing a relation between a film formation object and a nozzle in a case where a film is formed by using the film forming device shown in FIG. 1.

Next, a positional relation between the object and the nozzle 107 will be described with reference to FIG. 2. FIG. 2 is a perspective view showing a relation between a film formation object W and the nozzle 107 in a case where a film is formed by using the film forming device shown in FIG. 1. The film formation object W shown in FIG. 2 has an annular shape as a whole, and includes an upper surface W01 (a first flat surface), an outer surface W02 (a second flat surface), an inner surface W12, a curved surface W03, and a curved surface W13. The upper surface W01 is a flat surface constituting the annular shape. The outer surface W02 is substantially orthogonal to the upper surface W01, and vertically provided along an outer peripheral circle of the upper surface W01. The inner surface W12 is substantially orthogonal to the upper surface W01, and vertically provided along an inner peripheral circle of the upper surface W01. The curved surface W03 is a surface connecting the upper surface W01 to the outer surface W02. The curved surface W13 is a surface connecting the upper surface W01 to the inner surface W12.

Figure 3:
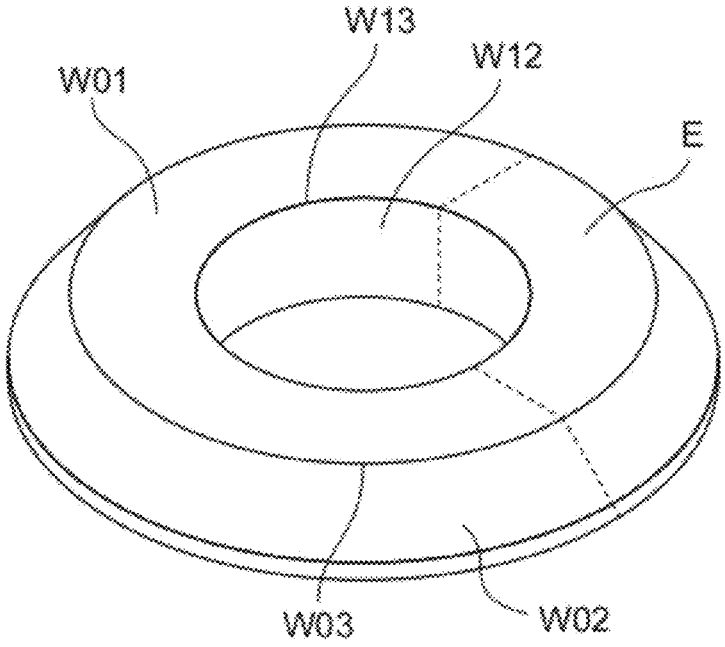
FIG. 3 is a perspective view showing a film formation object having a shape in which an angle formed between an outer surface and an upper surface is an obtuse angle, as an example of the film formation object.
Figure 4:
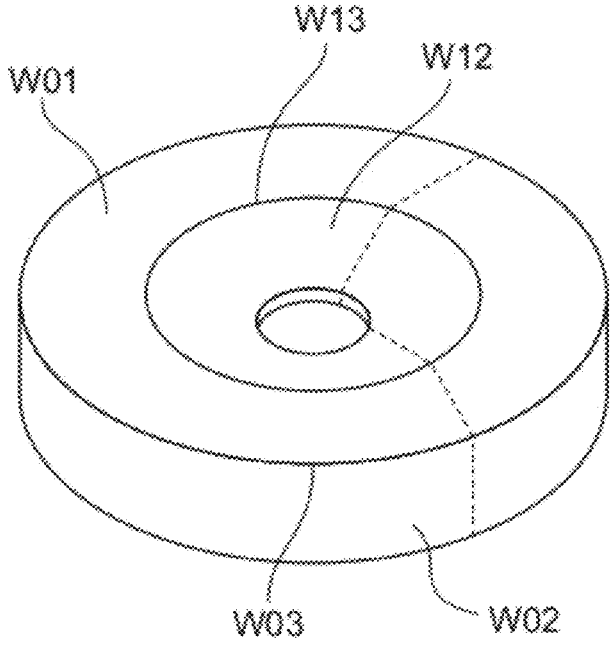
FIG. 4 is a perspective view showing a film formation object having a shape in which an angle formed between an inner surface and an upper surface is an obtuse angle, as another example of the film formation object.

FIG. 2 shows an example of the film formation object W having the outer surface W02 which is substantially orthogonal to the upper surface W01 as described above. However, a film forming method according to the present embodiment is not limited to application only to the film formation object W having such a shape. The method can be applied to, for example, the film formation object W in which an angle formed between the outer surface W02 and the upper surface W01 is an obtuse angle as shown in FIG. 3, i.e., an angle exceeding 90 degrees and smaller than 180 degrees. This also applies to an angle formed between the inner surface W12 and the upper surface W01. The method can be applied to a case where a film is continuously formed on the inner surface W12 and the upper surface W01 of the film formation object W in which an angle formed between the inner surface W12 and the upper surface W01 is an obtuse angle as shown in FIG. 4, i.e., an angle exceeding 90 degrees and smaller than 180 degrees.

Hereinafter, there will be described the film forming method according to the present embodiment in a case where in the film formation object W, the outer surface W02 is substantially orthogonal to the upper surface W01 thereof and the inner surface W12 is substantially orthogonal to the upper surface W01, especially excluding a case mentioned as an exception.

The nozzle 107 jets an aerosol Cp (an ultrafine particle material) through a tip thereof. A jet line JL along a jet direction of the aerosol Cp hits the film formation object W at a collision point Hp. The nozzle 107 is configured to move along a direction D2 with respect to the film formation object W. When the nozzle 107 moves along the direction D2, the collision point Hp moves along a movement line ML. The film formation object W is mounted on the sample table 109 so as to rotate along a direction D1.

It is to be noted that in FIG. 2, an x-axis and a y-axis are set so that a plane along the upper surface W01 becomes an xy-plane. The x-axis is set along the movement line ML and the direction D2, and the y-axis is set to be orthogonal to the x-axis. A z-axis is set along a center axis passing through a rotation center when the film formation object W rotates along the direction D1, so that the z-axis is orthogonal to the x-axis and the y-axis. The following description is made on the basis of the x-axis, the y-axis and the z-axis set in FIG. 2.

Figure 5:
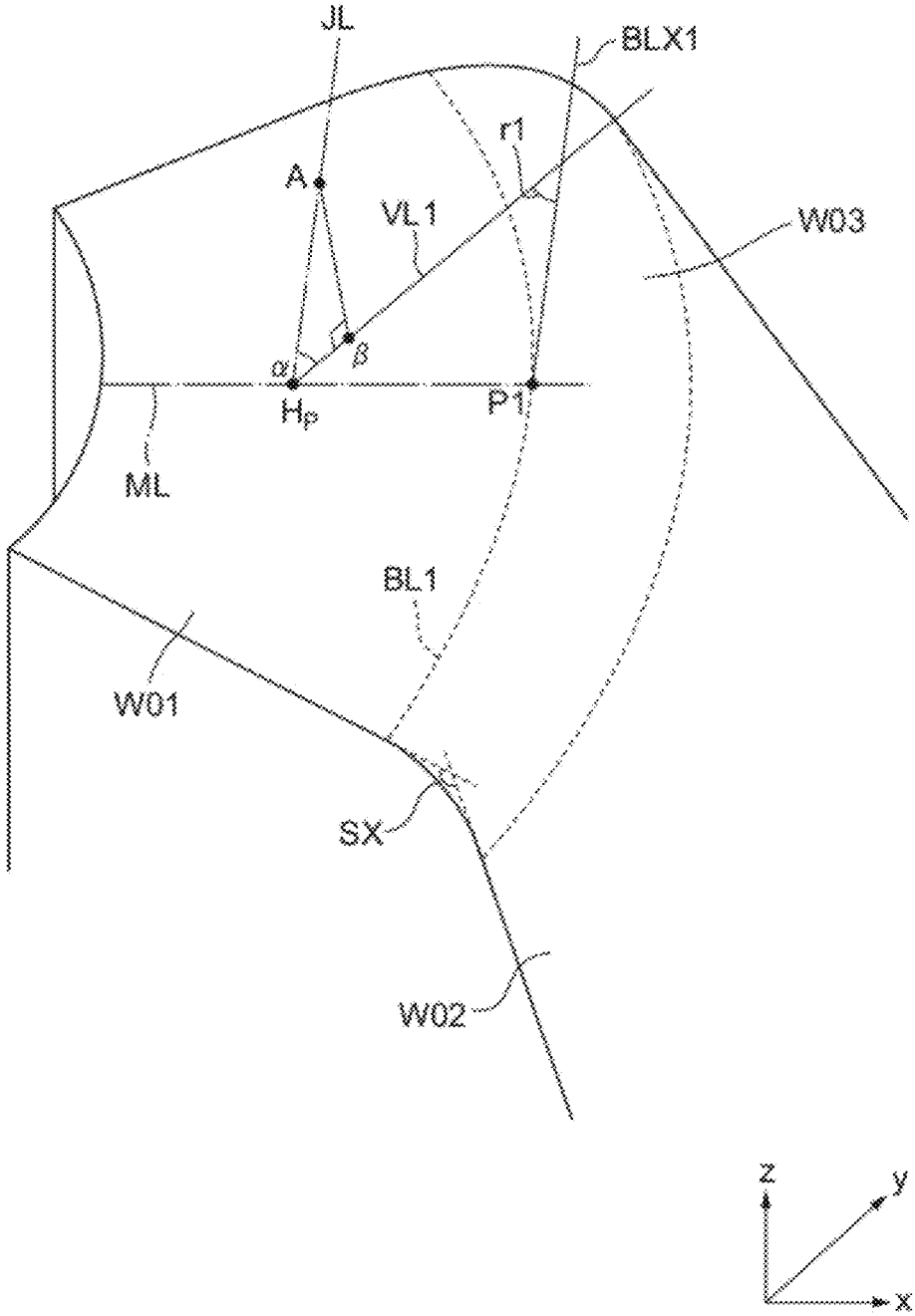
FIG. 5 is a perspective view for explaining an angle formed between the film formation object and a jet line along a jet direction of an ultrafine particle material in a first arranging step and a first film forming step.

FIG. 5 is a perspective view for explaining an angle formed between the film formation object W and the jet line JL along the jet direction of the aerosol Cp in a first arranging step and a first film forming step. It is to be noted that FIG. 5 shows an enlarged part E of the film formation object W having the shape shown in FIG. 3, to explain an angle SX formed between the upper surface W01 (the first flat surface) and the outer surface W02 (the second flat surface).

As shown in FIG. 5, an angle α formed between the jet line JL and the upper surface W01 in a case where the collision point Hp at which the jet line JL crosses the upper surface W01 moves along the movement line ML is an angle AHpB. A point A is an arbitrary point on the jet line JL. A point B is an intersection in the upper surface W01, when a normal is drawn from the point A down to the upper surface W01. In the present embodiment, the angle α formed when the film is formed on the upper surface W01 is set to an angle of 30 degrees to 60 degrees.

A point P1 indicates a spraying position when the spraying position of the aerosol Cp moves along the movement line ML on the upper surface W01 to reach the curved surface W03. When a line indicating a boundary between the upper surface W01 (the first flat surface) and the curved surface W03 is a first boundary line BL1, the point P1 is an intersection between the movement line ML and the first boundary line BL1 as shown in FIG. 5.

A first virtual line VL1 is a straight line obtained by projecting the jet line JL on the upper surface W01 (the first flat surface). In the present embodiment, an angle r1 formed between the first virtual line VL1 and the first boundary line BL1 at a point where the spraying position of the aerosol Cp changes to reach the curved surface W03, i.e., at the point P1 is set to an angle of 0 degree to 60 degrees. When a tangent which comes in contact with the first boundary line BL1 at the point P1 is a tangent BLX1, the angle r1 matches an angle formed between the first virtual line VL1 and the tangent BLX1 as shown in FIG. 5.

Figure 6:
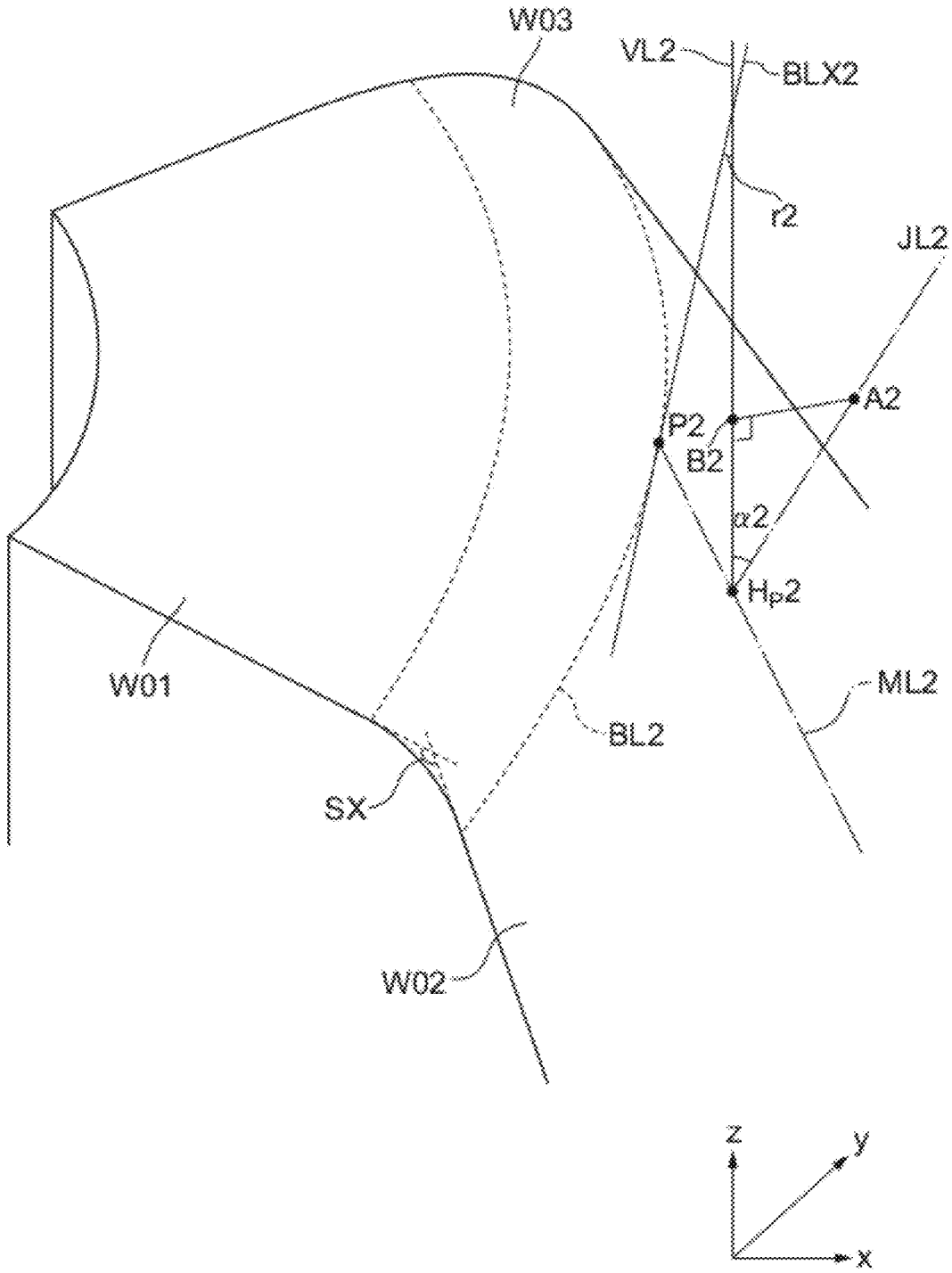
FIG. 6 is a perspective view for explaining an angle formed between the film formation object and the jet line along the jet direction of the ultrafine particle material in a second arranging step and a second film forming step.

FIG. 6 is a perspective view for explaining an angle formed between the film formation object W and a jet line JL2 along the jet direction of the aerosol Cp in a second arranging step and a second film forming step. The film formation object W in FIG. 6 is the same as that shown in FIG. 5. It is to be noted that in the second arranging step after the first film forming step is completed, the direction of the jet line JL2 does not change, and a direction of the film formation object W with respect to the jet line JL2 is changed. However, FIG. 6 shows the film formation object W in the same direction as FIG. 5, and shows the direction of the jet line JL2 which is different from that of the jet line JL in the first film forming step, for the convenience of the description.

As shown in FIG. 6, an angle α2 formed between the jet line JL2 and the outer surface W02 in a case where a collision point Hp2 at which the jet line JL2 crosses the outer surface W02 (the second flat surface) moves along a movement line ML2 is an angle A2Hp2B2. A point A2 is an arbitrary point on the jet line JL2. A point B2 is an intersection in a virtual plane, when a normal is drawn from the point A2 down onto the virtual plane which comes in contact with the outer surface W02 (the second flat surface) at Hp2. In the present embodiment, the angle α2 formed when the film is formed on the outer surface W02 is set to an angle of 30 degrees to 60 degrees.

A point P2 indicates a spraying position when the spraying position of the aerosol Cp moves along the movement line ML2 on the outer surface W02 (the second flat surface) to reach the curved surface W03. When a line indicating a boundary between the outer surface W02 (the second flat surface) and the curved surface W03 is a second boundary line BL2, the point P2 is an intersection between the movement line ML2 and the second boundary line BL2 as shown in FIG. 6.

A second virtual line VL2 is a straight line obtained by projecting the jet line JL2 on the virtual plane. The second virtual line VL2 matches a line obtained by projecting the jet line JL2 on the outer surface W02 at the point P2.

In the present embodiment, an angle r2 formed between the second virtual line VL2 and the second boundary line BL2 at a point where the spraying position of the aerosol Cp changes to reach the curved surface W03, i.e., at the point P2 is set to an angle of 0 degree to 60 degrees. When a tangent which comes in contact with the second boundary line BL2 at the point P2 is a tangent BLX2, the angle r2 matches an angle formed between the second virtual line VL2 and the tangent BLX2 as shown in FIG. 6.

In the shape of the film formation object W shown in FIG. 5 and FIG. 6, an angle SX formed between the first flat surface (the upper surface W01) and the second flat surface (the outer surface W02) is an obtuse angle, i.e., an angle exceeding 90 degrees and smaller than 180 degrees. The film forming method according to the present invention can be applied to a case where the angle SX is 90 degrees or larger and smaller than 180 degrees. Hereinafter, there will be described again the film formation object W having an angle SX of about 90 degrees, i.e., the film formation object W in which the upper surface W01 (the first flat surface) is substantially orthogonal to the outer surface W02 (the second flat surface), with reference to the drawings.

When the upper surface W01 (the first flat surface) is substantially orthogonal to the outer surface W02 (the second flat surface), the nozzle 107 is arranged so that a first side angle γ is from 30 degrees to 60 degrees, whereby the angle r1 formed between the first virtual line VL1 and the first boundary line BL1 can be set to an angle of 0 degree to 60 degrees. The first side angle γ will be described with reference to FIG. 7 and FIG. 8.

Figure 7:
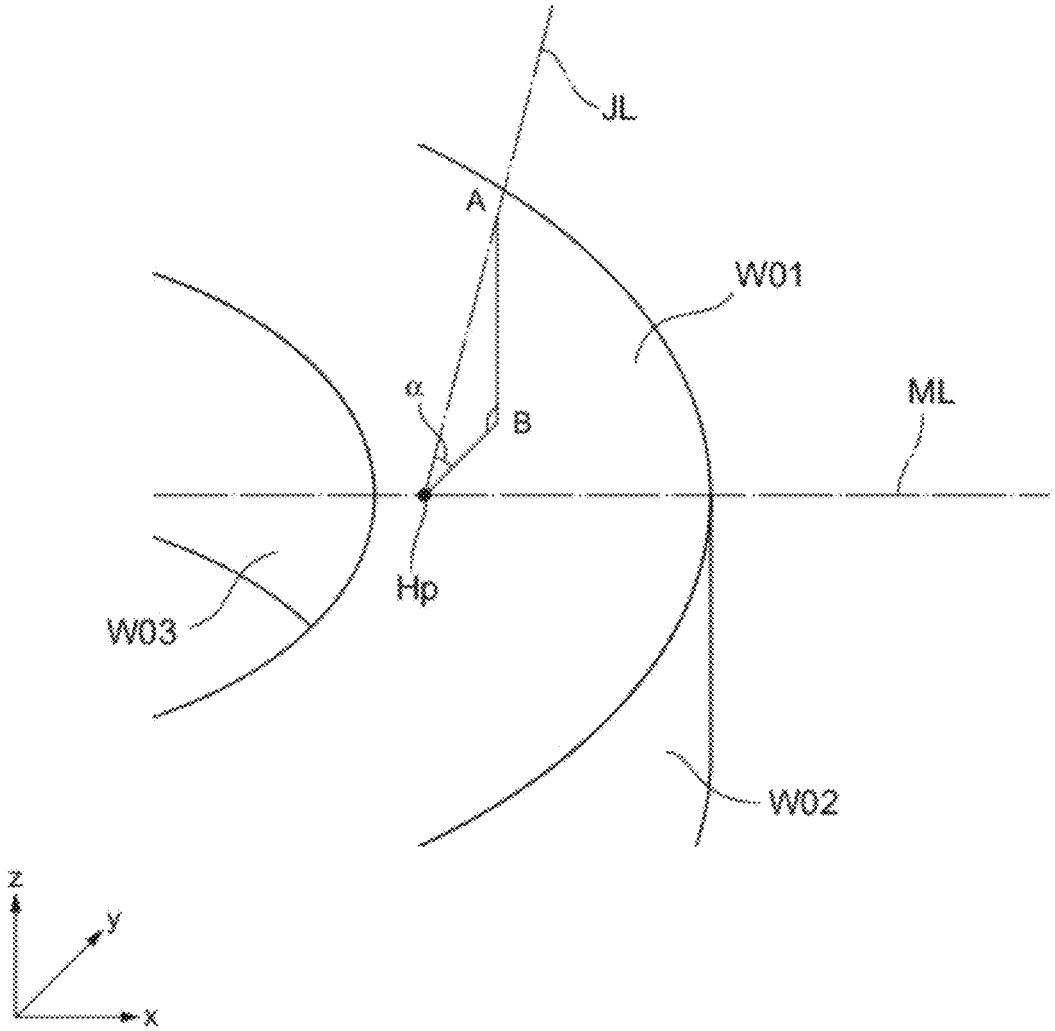
FIG. 7 is a perspective view for explaining an angle formed between the film formation object and the jet line along the jet direction of the ultrafine particle material.

FIG. 7 is a perspective view for explaining an angle formed between the film formation object W and the jet line JL along the jet direction of the aerosol Cp in a case where the upper surface W01 is substantially orthogonal to the outer surface W02. Also in FIG. 7, the angle α formed when the film is formed on the upper surface W01 is set to an angle of 30 degrees to 60 degrees in the same manner as in FIG. 5.

Figure 8:
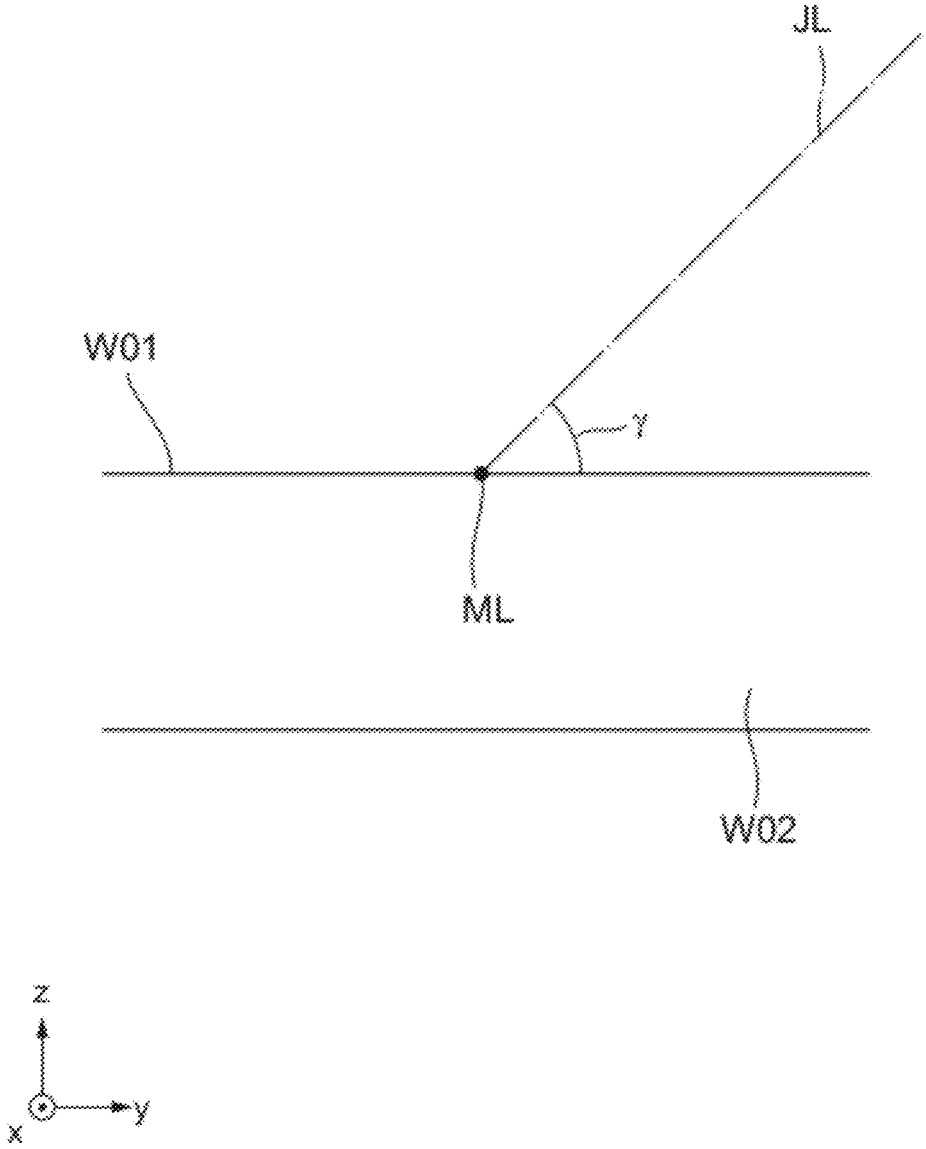
FIG. 8 is a diagram for explaining an angle between the film formation object and the jet line along the jet direction of the ultrafine particle material seen from a side.

FIG. 8 is a diagram for explaining an angle between the film formation object W and the jet line JL along the jet direction of the aerosol Cp seen from a side. As shown in FIG. 8, the first side angle γ is an apparent angle between the jet line JL and the upper surface W01 in a case where the movement line ML as a direction in which the spraying position of the aerosol Cp changes is seen through the side. More specifically, when the spraying position of the aerosol Cp moves along the movement line ML to reach the outermost periphery of the upper surface W01 and the spraying position is located on the curved surface W03, an apparent angle seen from a direction directly facing the outer surface W02 at the spraying position of the aerosol is the first side angle γ. In other words, the film formation object W has the annular shape, and the outer surface W02 has a cylindrical shape. Therefore, when the spraying position of the aerosol Cp is located on the curved surface W03, an apparent angle seen from a direction directly facing the surface which comes in contact with the outer surface W02 at the spraying position of the aerosol is the first side angle γ.

The first side angle γ is defined as described above. Therefore, when the upper surface W01 (the first flat surface) is substantially orthogonal to the outer surface W02 (the second flat surface), the nozzle is arranged so that the first side angle γ is an angle of 30 degrees to 60 degrees, whereby the angle r1 formed between the first virtual line VL1 and the first boundary line BL1 can be set to an angle of 0 degree to 60 degrees.

Figure 9:
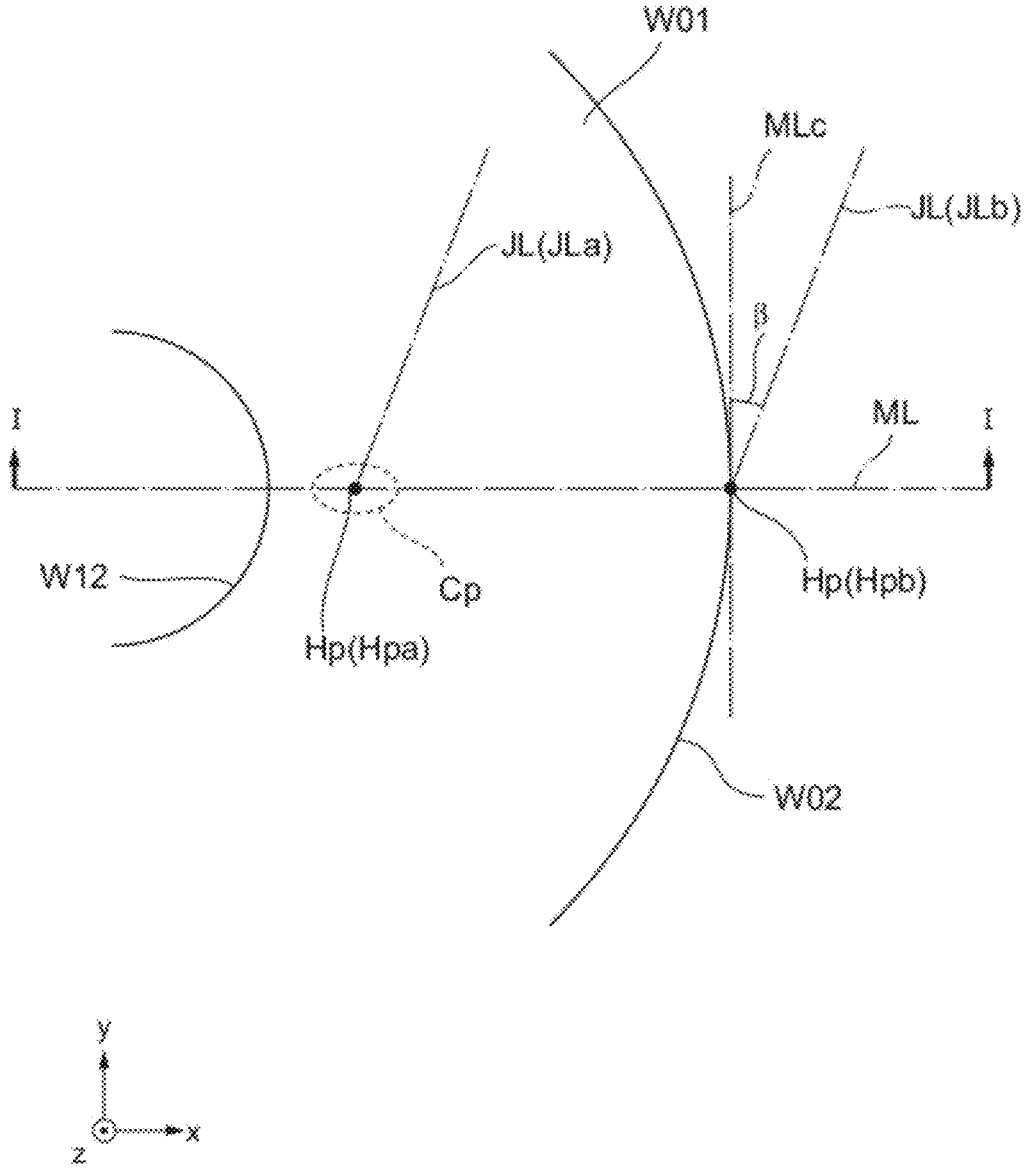
FIG. 9 is a diagram for explaining an angle between the film formation object and the jet line along the jet direction of the ultrafine particle material seen from an upside.

FIG. 9 is a diagram for explaining an angle between the film formation object W and the jet line JL along the jet direction of the aerosol Cp seen from an upside (from a side on the basis of the outer surface W02). In FIG. 9, the nozzle 107 and the film formation object W are relatively moved so that the collision point Hp where the jet line JL crosses the upper surface W01 moves on the movement line ML. When the collision point Hp is present at a position Hpa on the upper surface W01, the aerosol Cp collides with the upper surface W01 so as to form an elliptic shape. This elliptic region with which the aerosol Cp collides is formed so that a direction along the movement line ML (a direction in which the spraying position of the aerosol Cp changes toward the curved surface W03) becomes a long axis and a direction which is orthogonal to the movement line ML (a direction in which the spraying position of the aerosol Cp changes along the curved surface W03) becomes a short axis.

In the first film forming step in which the collision point Hp reaches the outer surface W02 (the second flat surface) and is located at a position Hpb, the angle formed between the outer surface W02 (the second flat surface) and the jet line JL at the position Hpb is set to be 60 degrees or smaller. In particular, when the upper surface W01 (the first flat surface) is substantially orthogonal to the outer surface W02 (the second flat surface) as in the present embodiment, the nozzle is arranged so that a second side angle β becomes an angle of 60 degrees or smaller, whereby an angle formed between the outer surface W02 (the second flat surface) and the jet line JL can be set to an angle of 60 degrees or smaller.

The second side angle β is an angle seen from a side directly facing the upper surface W01 (the first flat surface) in a case where the collision point Hp reaches the outer surface W02. In other words, the angle is an apparent angle between a tangent MLc on the outer surface W02 (the second flat surface) at the position Hpb and the jet line JL, in a case where the collision point Hp reaches the outer surface W02 (the second flat surface) and is located at the position Hpb.

The second side angle β is defined as described above. Therefore, when the upper surface W01 (the first flat surface) is substantially orthogonal to the outer surface W02 (the second flat surface), the nozzle is arranged so that the second side angle β becomes an angle of 60 degrees or smaller, whereby an angle formed between the outer surface W02 (the second flat surface) and the jet line JL can be set to an angle of 60 degrees or smaller.

Figure 10:
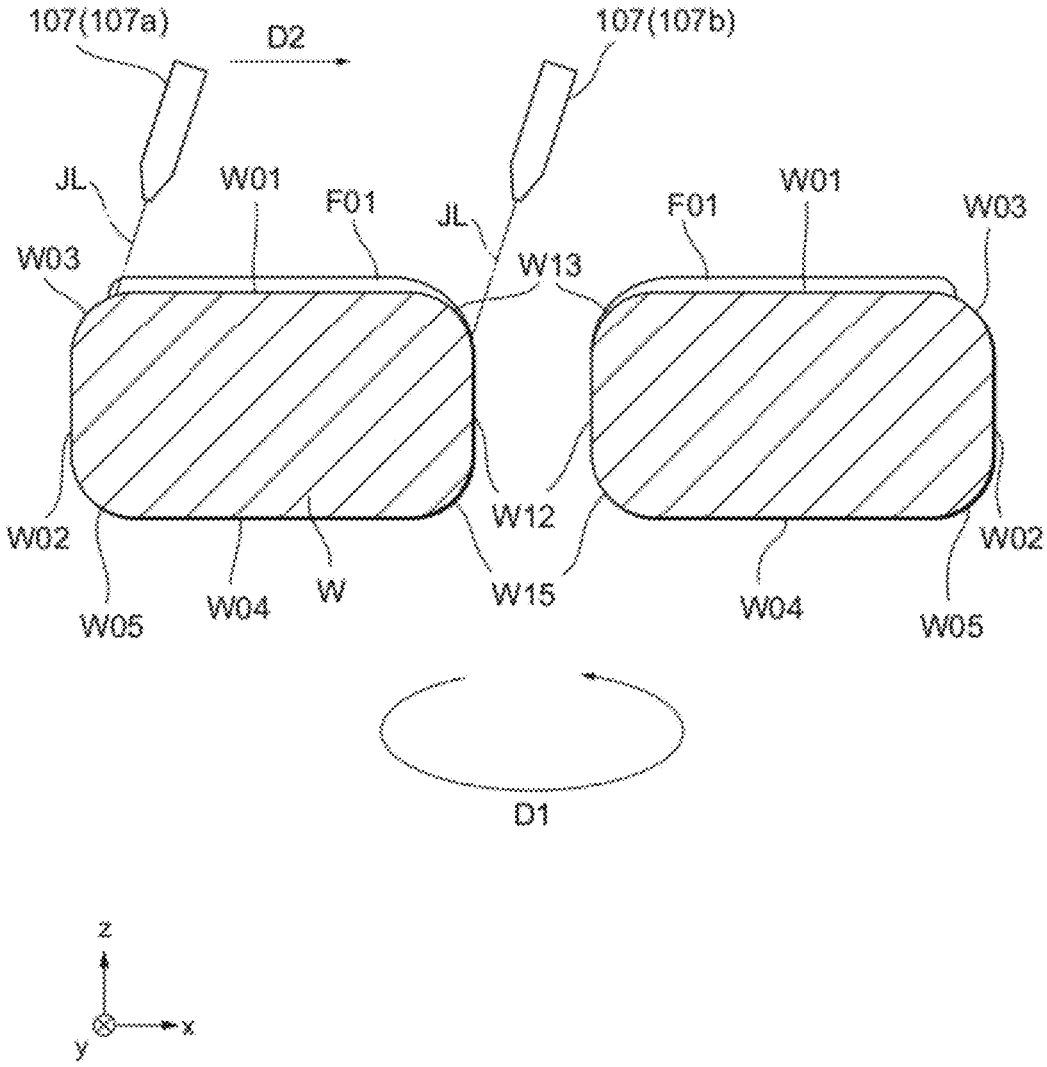
FIG. 10 is a view cut along the I-I line of FIG. 9, and showing a process of forming a film on the film formation object.
Figure 11:
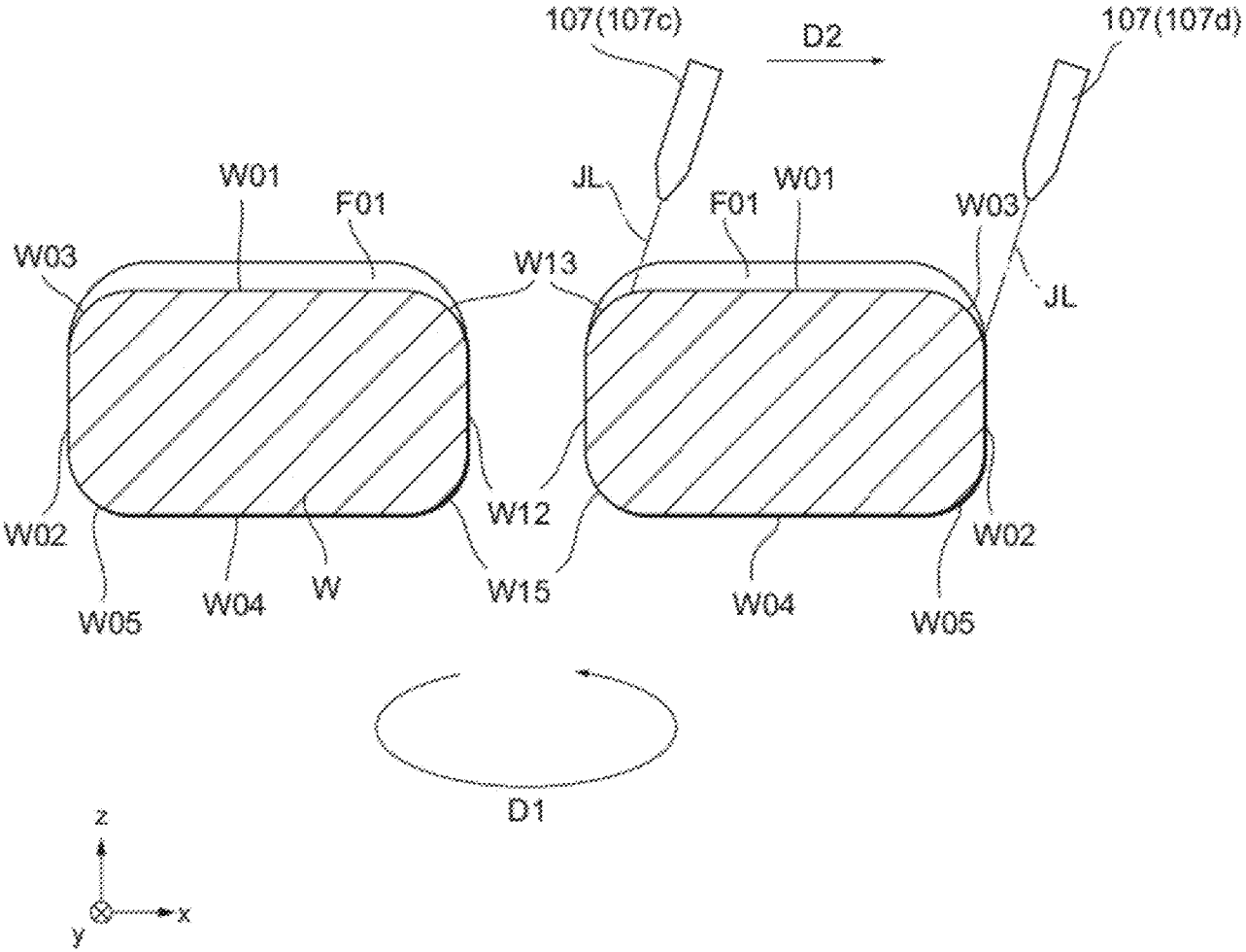
FIG. 11 is a view cut along the I-I line of FIG. 9, and showing the process of forming the film on the film formation object.
Figure 12:
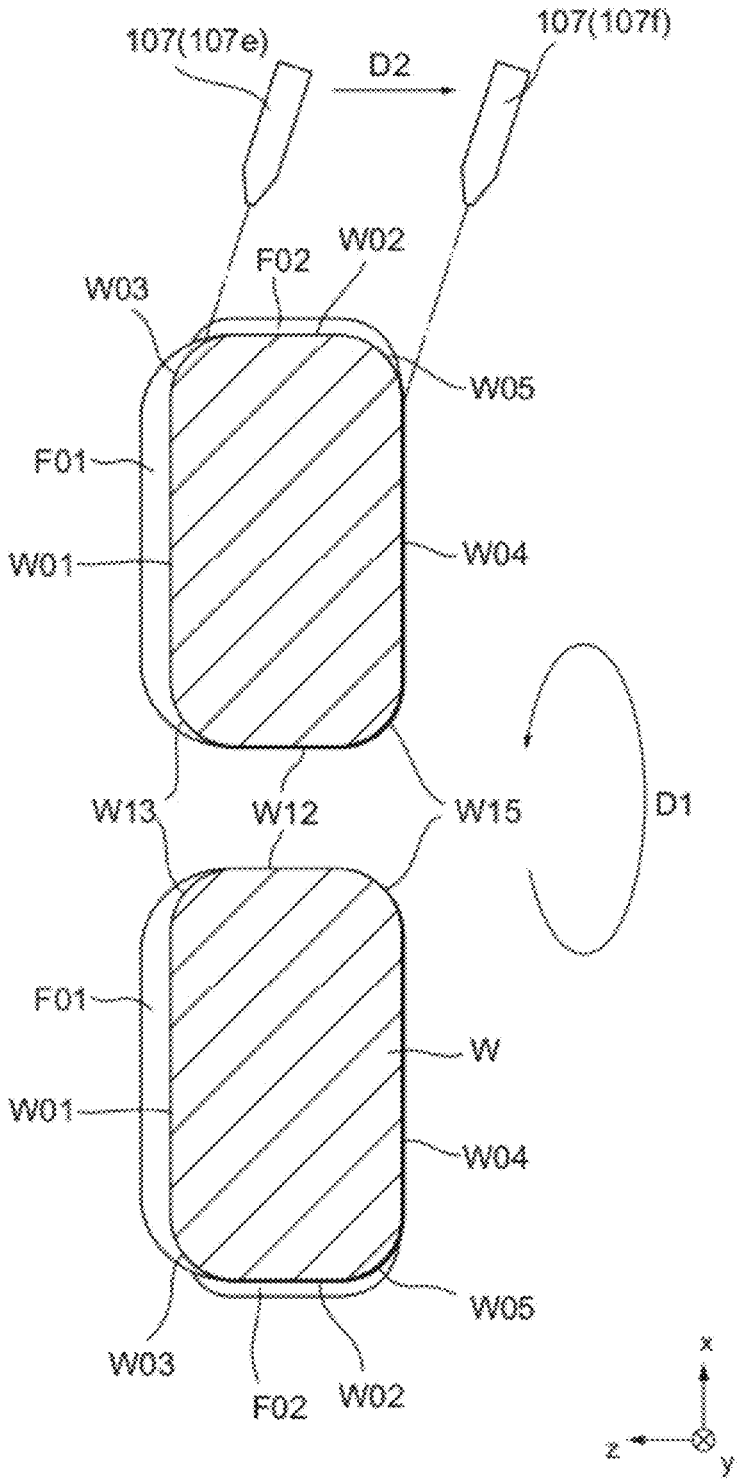
FIG. 12 is a view cut along the I-I line of FIG. 9, and showing the process of forming the film on the film formation object.
Figure 13:
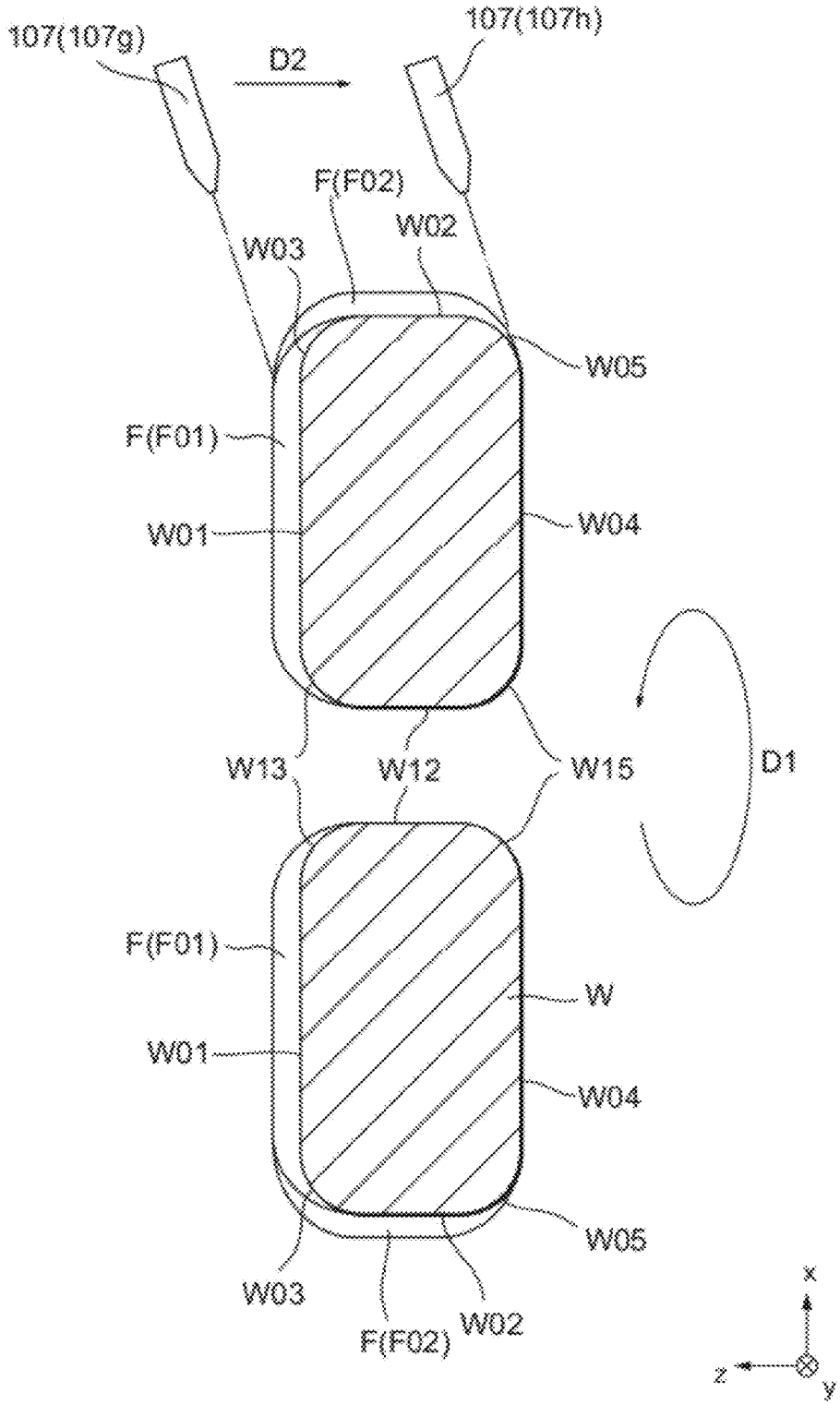
FIG. 13 is a view cut along the I-I line of FIG. 9, and showing the process of forming the film on the film formation object.

Next, a film forming method on the film formation object W will be described. The film forming method will be described with reference to FIG. 10 to FIG. 13. FIG. 10 and FIG. 11 are sectional views cut along the I-I line of FIG. 9, showing a forming process of the film on the film formation object W and mainly showing a forming process of the film on the upper surface W01 and the curved surfaces W03 and W13. FIG. 12 and FIG. 13 are sectional views cut along the I-I line of FIG. 9, showing a forming process of the film on the film formation object and mainly showing a forming process of the film on the outer surface W02, the curved surface W03 and a curved surface W05.

As shown in FIG. 10, the nozzle 107 is disposed away from the upper surface W01 while keeping a distance therefrom so that the aerosol can be sprayed on the surface. On the other hand, the nozzle 107 is arranged to face the upper surface W01 so that the angle of the jet line JL along the jet direction of the aerosol sprayed on the upper surface W01 is the angle α formed between the upper surface W01 and the jet line JL in a range of 30 degrees to 60 degrees and so that the first side angle γ seen from a side directly facing the inner surface W12 and the outer surface W02 is from 30 degrees to 60 degrees at the point where the spraying position of the aerosol changes to reach the curved surfaces W03 and W13 (a first arranging step). When the nozzle 107 is disposed in this manner, the angle r1 formed between the first virtual line VL1 and the first boundary line BL1 on the upper surface W01 defined as the first flat surface becomes an angle of 0 degree to 60 degrees, at the point where the spraying position of the aerosol changes to reach the curved surface W03.

In the present embodiment, the film is formed while moving the nozzle 107 in the direction D2 along the movement line ML and rotating the film formation object W along the direction D1. The nozzle 107 is moved so that the jet line JL moves from one outer side to the other outer side of the jet line JL.

FIG. 10 shows a film forming state in a case where the jet line JL moves from the one outer side of the film formation object W to the vicinity of the center thereof. When the nozzle 107 is moved from a position 107*a* to a position 107*b* so that the jet line JL moves from the one outer side of the film formation object W to the vicinity of the center thereof, the film formation object W is rotated, whereby a film F01 is formed on the upper surface W01. When the nozzle 107 tilts in such a tilt direction as to jet the aerosol to a rear side along the moving direction D2 of the nozzle 107, the jet direction of the aerosol directly faces the curved surface W13. Therefore, the film F01 is formed on the curved surface W13. On the other hand, while the nozzle 107 moves from the position 107*a* to the position 107*b*, the jet direction of the aerosol does not directly face the curved surface W03, whereby the film F01 is not formed on the curved surface W03.

FIG. 11 shows a film forming state in a case where the jet line JL moves from the vicinity of the center of the film formation object W to the other outer side thereof. When the nozzle 107 is moved from a position 107*c* to a position 107*d* so that the jet line JL moves from the vicinity of the center of the film formation object W to the other outer side thereof, the film formation object W is rotated, whereby the film F01 of the upper surface W01 grows. Since the nozzle 107 tilts in such a tilt direction as to jet the aerosol to the rear side along the moving direction D2 of the nozzle 107, the jet direction of the aerosol directly faces the curved surface W03 this time. Therefore, the film F01 is also formed on the curved surface W03. On the other hand, while the nozzle 107 moves from the position 107*c* to the position 107*d*, the jet direction of the aerosol does not directly face the curved surface W13, whereby the film F01 formed on the curved surface W13 does not grow.

When the film formation is performed as shown in FIG. 10 and FIG. 11, the aerosol is jetted from the nozzle 107, while keeping a distance and an angle between the nozzle 107 and film formation object W in the first arranging step. The aerosol is continuously sprayed while continuously changing the spraying position of the aerosol on the upper surface W01 and the curved surfaces W03 and W13 connected to the upper surface W01, whereby a film which covers the upper surface W01 and a film which covers at least part of the curved surfaces W03 and W13 (the first film forming step). It is to be noted that in the first arranging step and the first film forming step, the second side angle β between the jet line JL and the outer surface W02 seen from an upper surface W01 direction is set to an angle of 30 degrees. When the nozzle 107 is arranged in this manner, an angle formed between the outer surface W02 and the jet line JL becomes an angle of 60 degrees or smaller at the point where the spraying position of the aerosol changes to reach the outer surface W02.

Next, as shown in FIG. 12, the nozzle 107 is disposed apart from the outer surface W02, keeping a distance so that the nozzle can spray an aerosol on the outer surface. On the other hand, the nozzle 107 is disposed to face the outer surface so that the angle between the outer surface W02 and the jet line JL2 sprayed to the outer surface W02 becomes an angle of 30 degrees to 60 degrees and so that the first side angle γ seen though a side directly facing a lower surface W04 becomes the angle of 30 degrees to 60 degrees at a point where the spraying position of the aerosol changes to reach the curved surface W05 (a second arranging step).

FIG. 12 shows a film forming state in a case where the jet line JL2 moves from one outer side to the other outer side of the film formation object W. When the nozzle 107 moves from a position 107*e* to a position 107*f* so that the jet line JL2 moves from the one outer side to the other outer side of the film formation object W, the film formation object W is rotated to form a film F02 on the outer surface W02. As to the tilt direction of the nozzle 107, the nozzle 107 tilts so as to jet the aerosol to a rear side in the moving direction D2. Therefore, the jet direction of the aerosol directly faces the curved surface W05. Therefore, the film F02 is formed on the curved surface W05. On the other hand, while the nozzle 107 in this tilt direction moves from the position 107*e* to the position 107*f*, the jet direction of the aerosol does not directly face the curved surface W03. Therefore, the film F02 is not formed on the curved surface W03.

Next, as shown in FIG. 13, the tilt direction of the nozzle 107 is set so that the nozzle 107 tilts to jet the aerosol to a front side in the moving direction D2, whereby the jet direction of the aerosol directly faces the curved surface W03. Also in FIG. 13, the nozzle 107 is disposed away from the outer surface W02, keeping a distance so that the nozzle can spray the aerosol on the outer surface. On the other hand, the nozzle 107 is disposed to face the outer surface so that the angle between the outer surface W02 and the jet line JL2 sprayed to the outer surface W02 becomes an angle of 30 degrees to 60 degrees and so that the first side angle γ seen though a side directly facing the upper surface W01 becomes the angle of 30 degrees to 60 degrees at a point where the spraying position of the aerosol changes to reach the curved surface W03 (a second arranging step). When the nozzle 107 is arranged in this manner, the angle r2 formed between the second virtual line VL2 and the second boundary line BL2 on the outer surface W02 defined as the second flat surface becomes an angle of 0 degree to 60 degrees at a point where the spraying position of the aerosol changes to reach the curved surface W03.

In this arrangement, the nozzle 107 is moved from a position 107*g* to a position 107*h*, and the film formation object W is rotated, whereby the film F02 formed on the outer surface W02 grows. In the tilt direction of the nozzle 107, the nozzle 107 tilts to jet the aerosol to the front side in the moving direction D2, whereby the jet direction of the aerosol directly faces the curved surface W03. Therefore, the film F02 is formed on the curved surface W03. On the other hand, while the nozzle 107 in this tilt direction moves from the position 107*g* to the position 107*h*, the jet direction of the aerosol does not directly faces the curved surface W05, whereby the film F02 is not formed on the curved surface W05.

In FIG. 12 and FIG. 13, the film F02 is formed on both the curved surfaces W03 and W05. Therefore, when the tilt direction of the nozzle 107 is changed but it is sufficient to form the film F02 only on the curved surface W03, the film is preferably formed at an angle of nozzle 107 shown in FIG. 13. Moreover, when the film formation object W does not have a rectangular parallelepiped shape, the film cannot be formed while rotating the nozzle as in the present embodiment. Therefore, the tilt direction of the nozzle 107 is changed to form the film as described with reference to FIG. 12 and FIG. 13, which enables the formation of the film on the curved surface W03 as described above.

Figure 14:
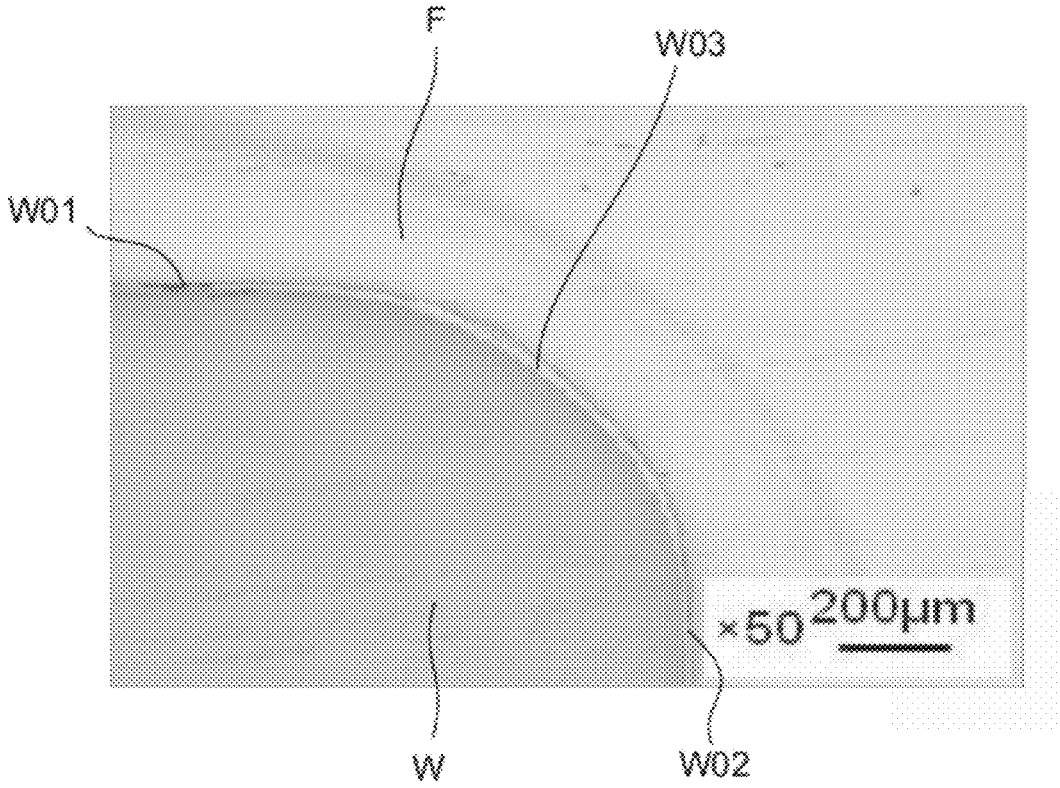
FIG. 14 is a photograph of a sectional view after the film is formed on the film formation object.

By the above film forming method, the film F01 is formed on the upper surface W01 and the curved surface W03, and the film F02 is formed on the outer surface W02 and the curved surface W03. In this case, the films F01 and F02 integrally form a film F. A photograph of a section of the film F is shown in FIG. 14. As shown in FIG. 14, the film F is integrally formed by the films F01 and F02. Therefore, a boundary between the film F01 and the film F02 disappears, and the completely integral film is formed. In consequence, the film formation which does not generate any boundary on the curved surface is a characteristic aspect of the film forming method of the present embodiment.

According to the above embodiment, the first film forming step (see FIG. 10 and FIG. 11) jets the aerosol from the nozzle 107, while keeping the distance and the angle between the nozzle 107 and the film formation object W and continuously changing the spraying position of the aerosol, to continuously form the film F01 which covers the upper surface W01 as the first flat surface and the film F01 which covers at least part of the curved surfaces W03 and W13. Therefore, the film F01 which covers the upper surface W01 and the film F01 which covers the curved surfaces W03 and W13 can integrally be formed, which enables the film formation which does not generate any gap in a joined portion.

Furthermore, the second film forming step (see FIG. 12 and FIG. 13) executed after the first film forming step jets the aerosol from the nozzle 107, while keeping the distance and the angle between the nozzle 107 and the film formation object W and continuously changing the spraying position of the aerosol, to continuously form the film F02 which covers the outer surface W02 as the second flat surface and the film F02 which further covers the film F01 formed on the curved surface W03 in the first film forming step. Therefore, the film F02 which covers the outer surface W02 and the film F02 which further covers the film F01 formed on the curved surface W03 can integrally be formed, which enables the film formation which does not generate any gap in the joined portion.

The curved surface W03 is noted. Since the film F02 formed in the second film forming step is superimposed on the film F01 formed in the first film forming step, the film F01 is formed in the first film forming step in consideration of high adhesion to the film formation object W. On the other hand, the film F02 is formed in the second film forming step in consideration of high adhesion to the film F01 of a lower layer and an appearance of the film, which enables optimized film formations in the respective steps.

Furthermore, in the present embodiment, the arrangement of the nozzle 107 with respect to the film formation object W is contrived in the first arranging step in order to more securely form the film on the upper surface W01 and the curved surfaces W03 and W13 in the first film forming step. Specifically, the nozzle 107 is disposed away from the upper surface W01, keeping the distance so that the nozzle can spray the aerosol on the upper surface. On the other hand, the nozzle is arranged so that the angle $\alpha$ formed between the upper surface W01 and the jet line JL sprayed to the upper surface W01 becomes the angle of 30 degrees to 60 degrees.

In such arrangement, the nozzle 107 can be arranged to obtain an incident angle which is appropriate for the formation of the film on the upper surface W01. When the film formation only on the upper surface W01 is taken into consideration, the angle $\alpha$ formed between the upper surface W01 and the jet line JL may appropriately be set. Therefore, the incident direction of the jet line JL on the upper surface W01 can be varied as long as the angle $\alpha$ is held.

The present inventors have noted this respect, and have arranged the nozzle to further satisfy additional conditions while securing the above conditions on the angle $\alpha$ formed between the upper surface W01 and the jet line JL. That is, when the boundary between the upper surface W01 which is the first flat surface and the curved surface W03 is the first boundary line BL1, the nozzle is arranged so that the angle formed between the first virtual line VL1 obtained by projecting the jet line JL on the upper surface W01 and the first boundary line BL1 is in a range of 0 degree to 60 degrees at the point where the spraying position of the aerosol changes to reach the curved surface W03.

When the angle between the film formation object W and the nozzle 107 is contrived and set in this manner, the first film forming step can securely form a high-quality film even on the film formation object W having the curved surfaces W03 and W13 with a remarkably small curvature radius by a simple process of moving the nozzle 107 and the film formation object W to perform a relative two-dimensional motion (e.g. a motion to rotate the object or move the nozzle in parallel with the object).

Further in the present embodiment, the arrangement of the nozzle 107 with respect to the film formation object W is contrived in the second arranging step, to more securely form the film on the outer surface W02 and the curved surface W03 in the second film forming step (see FIG. 12 and FIG. 13). Specifically, the nozzle 107 is disposed away from the outer surface W02, keeping a distance so that the nozzle can spray the aerosol on the outer surface, whereas the nozzle is arranged so that as the angle between the outer surface W02 and the jet line JL2, the angle $\alpha 2$ formed between the outer surface W02 and the jet line JL2 becomes the angle of 30 degrees to 60 degrees. When the nozzle is arranged in this manner, the nozzle 107 can be arranged to obtain the incident angle which is appropriate for the film formation on the outer surface W02. When the film formation only on the outer surface W02 is taken into consideration, the angle α2 formed between the outer surface W02 and the jet line JL2 may appropriately be set. Therefore, the incident direction of the jet line JL2 on the outer surface W02 can be varied as long as the angle α2 is held.

The present inventors have noted this respect, and have arranged the nozzle to further satisfy additional conditions on the angle between the outer surface W02 and the jet line JL2 while securing the above conditions on the angle α2 formed between the upper surface W02 and the jet line JL2. That is, when the boundary between the outer surface W02 which is the second flat surface and the curved surface W03 is the second boundary line BL2, the nozzle is arranged so that the angle formed between the second virtual line VL2 obtained by projecting the jet line JL2 on the outer surface W02 and the second boundary line BL2 is in a range of 0 degree to 60 degrees at the point where the spraying position of the aerosol changes to reach the curved surface W03.

When the angle between the film formation object W and the nozzle 107 is contrived and set in this manner, the second film forming step can also securely form the high-quality film even on the film formation object W having the curved surfaces W03 and W05 with a remarkably small curvature radius by a simple process of moving the nozzle 107 and the film formation object W to perform the relative two-dimensional motion (e.g. the motion to rotate the object or move the nozzle in parallel with the object).

Moreover, in the present embodiment, the first arranging step preferably arranges the nozzle 107 and the film formation object W so that the angle α formed between the upper surface W01 and the jet line JL is larger than the angle r1 formed between the first virtual line VL1 and the first boundary line BL1.

In this preferable arrangement, the first arranging step arranges the nozzle 107 and the film formation object W so that the angle α formed between the upper surface W01 and the jet line JL becomes larger than the angle r1 between the first virtual line VL1 on the upper surface W01 defined as the first flat surface and the first boundary line BL1. In consequence, the angle α formed between the upper surface W01 and the jet line JL is set to be remarkably large, whereas the angle r1 between the first virtual line VL1 and the first boundary line BL1 can be set to be relatively small.

Therefore, when the first film forming step sprays the aerosol on the upper surface W01, efficient film formation is enabled, and a film forming speed can be kept to be high. Since the second film forming step also forms the film on the curved surface W03, it is preferably considered that the high adhesion to the film formation object W are important in the film formation on the curved surface W03 in the first film forming step, which does not generate a defect such as peeling. Therefore, the first arranging step sets the angle r1 formed between the first virtual line VL1 and the first boundary line BL1 to be relatively small, and sets a jet angle of the aerosol on the curved surface W03 to be small, whereby the high-quality film can be formed.

In particular, when the first flat surface (the upper surface W01) is substantially orthogonal to the second flat surface (the outer surface W02 or the inner surface W12), the nozzle 107 and the film formation object W may be arranged so that the first side angle γ becomes smaller than the angle α formed between the upper surface W01 and the jet line JL.

Moreover, in the present embodiment, the second arranging step preferably arranges the nozzle 107 and the film formation object W so that the angle α2 formed between the outer surface W02 which is the second flat surface and the jet line JL2 is larger than the angle formed between the second virtual line VL2 and the second boundary line BL2 and so that the angle r2 between the second virtual line VL2 and the second boundary line BL2 is larger than the angle r1 formed between the first virtual line VL1 and the first boundary line BL1 in the first arranging step.

In particular, when upper surface W01 is substantially orthogonal to the outer surface W02, the nozzle 107 and the film formation object W may be arranged so that the angle α2 formed between the outer surface W02 and the jet line JL2 becomes larger than the angle r2 formed between the second virtual line VL2 and the second boundary line BL2 and so that the second side angle β in the second arranging step becomes larger than the first side angle γ in the first arranging step. Also in this case, the arrangement of the nozzle 107 satisfies the above conditions.

In this preferable arrangement, the second arranging step arranges the nozzle 107 and the film formation object W so that the angle α2 formed between the outer surface W02 and the jet line JL2 becomes larger than the angle r2 formed between the second virtual line VL2 on the outer surface W02 defined as the second flat surface and the second boundary line BL2. In consequence, the angle α2 formed between the outer surface W02 and the jet line JL2 is set to be relatively large, whereas the angle r2 formed between the second virtual line VL2 and the second boundary line BL2 can be set to be relatively small.

Therefore, when the second film forming step sprays the aerosol on the outer surface W02, the efficient film formation is enabled, and the high film forming speed can be kept. Since the first film forming step already forms the film on the curved surface W03, the angle r2 formed between the second virtual line VL2 and the second boundary line BL2 is set to be relatively small, to lower the film forming speed. It is eventually possible to prevent the film formed on the curved surface W03 from being excessively thick.

In this preferable configuration, the nozzle and the object are further arranged so that the angle r2 formed between the second virtual line VL2 and the second boundary line BL2 in the second arranging step becomes larger than the angle r1 formed between the first virtual line VL1 and the first boundary line BL1 in the first arranging step. In consequence, the angle r2 formed between the second virtual line VL2 and the second boundary line BL2 in the second arranging step can be set to be relatively large as compared with the angle r1 formed between the first virtual line VL1 and the first boundary line BL1 in the first arranging step. When the angle r2 formed between the second virtual line VL2 and the second boundary line BL2 is set to be large, the film forming speed on the curved surface W03 in the second film forming step can further be increased.

As described above, the first film forming step already forms the film on the curved surface W03. Therefore, even if the film forming speed of the film to be superimposed on the above film, a defect such as peeling does not easily occur. Therefore, when the angle formed between the second virtual line VL2 and the second boundary line BL2 is set as in this preferable configuration, it is possible to acquire the high adhesion of the film formed on the curved surface W03 to the object and a productivity thereof.

Moreover, in the present embodiment, the first arranging step preferably arranges the nozzle 107 and the film formation object W so that the angle α2 formed between the outer surface W02 which is the second flat surface and the jet line JL2 is 60 degrees or smaller.

In particular, when the upper surface W01 is substantially orthogonal to the outer surface W02, the first arranging step may arrange the nozzle 107 and the film formation object W so that as the angle formed between the outer surface W02 and the jet line JL, the second side angle β is 60 degrees or smaller. Also in this case, the arrangement of the nozzle 107 satisfies the above conditions.

In this preferable configuration, as the angle formed between the outer surface W02 and the jet line JL in the first arranging step, the second side angle β is set to be 60 degrees or smaller. Therefore, even when the aerosol jetted from the nozzle 107 reaches the outer surface W02 in the first film forming step, the incident angle on the outer surface W02 does not exceed 60 degrees. In consequence, it is possible to prevent a low-quality film having low adhesion properties from being formed on the outer surface W02 on which any film is not formed yet.

It is to be noted that when the upper surface W01 is substantially orthogonal to the outer surface W02, the nozzle and the film formation object W are preferably arranged so that in the first arranging step, as the angle formed between the outer surface W02 and the jet line JL, the second side angle β is 30 degrees or smaller and so that in the second arranging step, as the angle formed between the upper surface W01 and the jet line, the first side angle γ is 30 degrees or smaller. When the upper surface W01 is substantially orthogonal to the outer surface W02, the nozzle is arranged in this manner. In this case, even when the aerosol jetted from the nozzle 107 reaches the outer surface W02 in the first film forming step, the incident angle on the outer surface W02 is small, whereby the angle can be set so that the aerosol does not contribute to the film formation. Therefore, the first film forming step can prevent the film from being formed on the outer surface W02, whereby it is possible to prevent unnecessary film formation on the outer surface W02 which is not assumed as a film forming surface in the first film forming step.

Similarly, as the angle formed between the upper surface W01 and the jet line JL2, the first side angle is set to be 30 degrees or smaller in the second arranging step. Therefore, even when the aerosol jetted from the nozzle reaches the upper surface W01 in the second film forming step, the incident angle on the upper surface W01 is small, whereby the angle can be set so that the aerosol does not contribute to the film formation. In consequence, the first film forming step as well as the second film forming step can prevent the unnecessary film formation on the flat surface which is not assumed as the film forming surface, whereby a uniform film can be formed as a whole.

Moreover, in the present embodiment, the first film forming step and the second film forming step jet the aerosol from the nozzle 107 so that the aerosol is sprayed to spread more in a direction in which the spraying position of the aerosol changes toward the curved surface W03 than in a direction in which the spraying position of the aerosol changes along the curved surface W03.

When the film is formed on the curved surface W03, repeating of a film forming operation a plurality of times while suppressing a thickness of the film formed at a time is more preferable than the forming of a thick film at a time, from the viewpoint of acquiring uniformities of the film thickness and film quality. Therefore, the aerosol is jetted from the nozzle 107 so that the aerosol is sprayed to spread more in the direction in which the spraying position of the aerosol changes toward the curved surface W03. In consequence, even when the spraying position is changed along the curved surface W03, part of the film does not become thick but the film can be formed by superimposing thin films.

Moreover, in the present embodiment, the first film forming step fixes the nozzle, and moves the film formation object W along the upper surface W01, to change the spraying position of the aerosol, and the second film forming step fixes the nozzle 107, and moves the film formation object W along the outer surface W02, to change the spraying position of the aerosol.

In this manner, both the first film forming step and the second film forming step fix the nozzle, and move the film formation object W along the upper surface W01 and the outer surface W02, respectively, to change the spraying position of the aerosol. Therefore, it is possible to form the film while the nozzle 107 is not moved. Therefore, when the nozzle 107 is fixed, a state of the jetted aerosol can be stabilized, and the uniformities of the film thickness and film quality can be acquired.

The embodiments of the present invention have been described above with respect to the specific examples. However, the present invention is not limited to these specific examples. That is, these specific examples appropriately changed in design by a person skilled in the art are included in the scope of the present invention as long as the characteristics of the present invention are provided. For example, elements provided in the above specific examples, arrangements, materials, conditions, shapes and sizes of the elements, and the like are not limited to illustrated ones, and can appropriately be changed. Moreover, the respective elements of the embodiments can be combined as many as technically possible, and the combinations are included in the scope of the present invention as long as the characteristics of the present invention are included.

DESCRIPTION OF REFERENCE NUMERALS

10: film forming device
101: gas container
102: aerosol generator
103: film forming chamber
104: vacuum pump
105: carrier gas flow path
106: aerosol flow path
107: nozzle
108: stage
109: sample table

What is claimed is:

1. A film forming method by an aerosol deposition method which sprays an aerosol jetted from a nozzle on an object including a first flat surface, a second flat surface having an angle of 90 degrees or larger and smaller than 180 degrees between the first flat surface and the second flat surface and a curved surface connecting the first flat surface to the second flat surface, while continuously changing a spraying position of the aerosol, to form a film which continuously covers the first flat surface, the second flat surface and the curved surface, the film forming method comprising:

a first arranging step of arranging the nozzle so that an angle formed between a jet line along a jet direction of the aerosol and the first flat surface is in a range of 30 degrees to 60 degrees and so that an angle formed between a first virtual line obtained by projecting the jet line on the first flat surface and a first boundary line is in a range of 0 degree to 60 degrees in a case where the nozzle is positioned so that the jet line hits the first boundary line which is a boundary between the first flat surface and the curved surface;

a first film forming step of jetting the ultrafine particle material from the nozzle, while keeping a distance and an angle between the nozzle and the first flat surface, and continuously spraying the aerosol on the first flat surface and the curved surface connected to the first flat surface, to continuously form a film which covers the first flat surface and a film which covers at least part of the curved surface;

a second arranging step of arranging the nozzle so that an angle formed between the jet line along the jet direction of the aerosol and the second flat surface is in a range of 30 degrees to 60 degrees and so that an angle formed between a second virtual line obtained by projecting the jet line on the second flat surface and a second boundary line is in a range of 0 degree to 60 degrees in a case where the nozzle is positioned so that the jet line hits the second boundary line which is a boundary between the second flat surface and the curved surface; and a second film forming step of jetting the aerosol from the nozzle, while keeping a distance and an angle between the nozzle and the second flat surface, and continuously spraying the aerosol on the second flat surface and the curved surface connected to the second flat surface, to continuously form a film which covers the second flat surface and a film which further covers the film formed on the curved surface in the first film forming step.

2. The film forming method according to claim 1, wherein the first arranging step arranges the nozzle and the object so that the angle formed between the jet line and the first flat surface is larger than the angle between the first virtual line and the first boundary line.

3. The film forming method according to claim 2, wherein the second arranging step arranges the nozzle and the object so that the angle formed between the jet line and the second flat surface is larger than the angle formed between the second virtual line and the second boundary line and so that the angle formed between the second virtual line and the second boundary line is larger than the angle formed between the first virtual line and the first boundary line in the first arranging step.

4. The film forming method according to claim 1, wherein the first arranging step arranges the nozzle and the object so that the angle formed between the jet line and the second flat surface is 60 degrees or smaller.

5. The film forming method according to claim 1, wherein the first film forming step and the second film forming step jet the aerosol from the nozzle so that the material is sprayed to spread more in a direction in which the spraying position of the aerosol changes toward the curved surface than in a direction in which the spraying position of the aerosol changes along the curved surface.

6. The film forming method according to claim 1, wherein in the first film forming step, the nozzle is fixed, and the object is moved along the first flat surface, to change the spraying position of the aerosol, and in the second film forming step, the nozzle is fixed, and the object is moved along the second flat surface, to change the spraying position of the aerosol.

* * * * *